US007117120B2

(12) United States Patent
Beck et al.

(10) Patent No.: US 7,117,120 B2
(45) Date of Patent: Oct. 3, 2006

(54) CONTROL SYSTEM FOR CENTRIFUGAL PUMPS

(75) Inventors: Thomas L. Beck, Union Grove, WI (US); Robb G. Anderson, Racine, WI (US); Steven J. Olson, Racine, WI (US)

(73) Assignee: Unico, Inc., Franksville, WI (US)

( * ) Notice: Subject to any disclaimer, the term of this patent is extended or adjusted under 35 U.S.C. 154(b) by 128 days.

(21) Appl. No.: 10/656,091

(22) Filed: Sep. 5, 2003

(65) Prior Publication Data

US 2004/0064292 A1 Apr. 1, 2004

Related U.S. Application Data

(60) Provisional application No. 60/429,158, filed on Nov. 26, 2002, provisional application No. 60/414,197, filed on Sep. 27, 2002.

(51) Int. Cl.
*G06F 11/30* (2006.01)
*G06F 15/00* (2006.01)
*G21C 17/00* (2006.01)

(52) U.S. Cl. ..... 702/182

(58) Field of Classification Search ..... 702/182
See application file for complete search history.

(56) References Cited

U.S. PATENT DOCUMENTS 3,343,409 A 9/1967 Gibbs
3,585,484 A 6/1971 Dortort
3,851,995 A 12/1974 Mills
3,854,846 A 12/1974 Douglas
3,915,225 A 10/1975 Swink
3,918,843 A 11/1975 Douglas et al.
3,930,752 A 1/1976 Douglas
3,936,231 A 2/1976 Douglas
3,938,910 A 2/1976 Douglas
3,951,209 A 4/1976 Gibbs
3,963,374 A 6/1976 Sullivan
3,965,983 A 6/1976 Watson
3,998,568 A 12/1976 Hynd
4,058,757 A 11/1977 Welton et al.
4,102,394 A 7/1978 Botts
4,108,574 A * 8/1978 Bartley et al. ..... 417/19
4,118,148 A 10/1978 Allen
4,145,161 A 3/1979 Skinner
4,171,185 A 10/1979 Duke et al.
4,194,393 A 3/1980 Boley (Continued)

OTHER PUBLICATIONS

Gibbs, S.C.: "Predicting the Behavior of Sucker-Rod Pumping Systems", JPT (Jul. 1963, 769-78, Trans, AIME 228.

(Continued)

*Primary Examiner*—Michael Nghiem
(74) *Attorney, Agent, or Firm*—Reinhard Boerner Van Deuren s.c.

(57) ABSTRACT

A control system for the operation of a centrifugal pump which may be used for production of gas and/or oil from a well. The control system includes vector feedback model to derive values of torque and speed from signals indicative of instantaneous current and voltage drawn by the pump motor, a pump model which derives values of the fluid flow rate and the head pressure for the pump from torque and speed inputs, a pumping system model that derives from the estimated values of the pump operating parameters an estimated value of a pumping system parameter and controllers responsive to the estimated values of the pumping system parameters to control the pump to maintain fluid level at the pump input near an optimum level.

92 Claims, 16 Drawing Sheets

U.S. PATENT DOCUMENTS 4,220,440 A 9/1980 Taylor et al.
4,286,925 A 9/1981 Standish
4,363,605 A 12/1982 Mills
4,390,321 A 6/1983 Langlois et al.
4,406,122 A 9/1983 McDuffie
4,438,628 A 3/1984 Creamer
4,474,002 A 10/1984 Perry
4,476,418 A 10/1984 Werner
4,480,960 A 11/1984 Streib
4,483,188 A 11/1984 McTamaney et al.
4,487,061 A 12/1984 McTamaney et al.
4,490,094 A 12/1984 Gibbs
4,507,055 A 3/1985 Fair et al.
4,508,487 A 4/1985 Taylor et al.
4,508,488 A 4/1985 Pikna
4,509,901 A 4/1985 McTamaney et al.
4,534,168 A 8/1985 Brantly
4,534,706 A 8/1985 Palm et al.
4,541,274 A 9/1985 Purcupile
4,594,665 A 6/1986 Chandra et al.
4,631,954 A 12/1986 Mills
4,661,751 A 4/1987 Werner
4,695,779 A 9/1987 Yates
4,741,397 A 5/1988 Weeks
4,747,451 A 5/1988 Adams, Jr. et al.
4,830,112 A 5/1989 Erickson
4,859,151 A 8/1989 Reed
4,873,635 A 10/1989 Mills
4,935,685 A 6/1990 Justus et al.
4,971,522 A 11/1990 Butlin
4,973,226 A 11/1990 McKee
5,006,044 A 4/1991 Walker, Sr. et al.
5,044,888 A 9/1991 Hester, II
5,064,349 A 11/1991 Turner et al.
5,129,264 A 7/1992 Lorenc
5,129,267 A 7/1992 Nicholls
5,167,490 A 12/1992 McKee et al.
5,180,289 A 1/1993 Wenholz et al.
5,204,595 A 4/1993 Opal et al.
5,222,867 A 6/1993 Walker, Sr. et al.
5,224,834 A 7/1993 Westerman et al.
5,237,863 A 8/1993 Dunham
5,240,380 A * 8/1993 Mabe ..... 417/43
5,246,076 A 9/1993 Watson
5,251,696 A 10/1993 Boone et al.
5,252,031 A 10/1993 Gibbs
5,281,100 A 1/1994 Diederich
5,284,422 A 2/1994 Turner et al.
5,316,085 A 5/1994 Dawson
5,318,409 A 6/1994 London et al.
5,362,206 A 11/1994 Westerman et al.
5,372,482 A 12/1994 London et al.
5,425,623 A 6/1995 London et al.
5,441,389 A 8/1995 Wolcott et al.
5,444,609 A 8/1995 Swamy et al.
5,458,466 A 10/1995 Mills
5,634,522 A 6/1997 Hershberger
5,819,849 A 10/1998 Booth
5,829,530 A 11/1998 Nolen
5,868,029 A 2/1999 Paine
5,941,305 A 8/1999 Thrasher et al.
5,996,691 A 12/1999 Norris et al.
6,041,856 A 3/2000 Thrasher et al.
6,043,569 A 3/2000 Ferguson
6,079,491 A 6/2000 Stuebinger et al.
6,092,600 A 7/2000 McKinzie et al.
6,127,743 A 10/2000 Levin et al.
6,129,110 A 10/2000 Kolb
6,155,347 A 12/2000 Mills
6,176,682 B1 1/2001 Mills
6,464,464 B1 10/2002 Sabini et al.
6,585,041 B1 7/2003 Crossley
6,592,340 B1 * 7/2003 Horo et al. ..... 417/293
2003/0235492 A1 * 12/2003 Mirsky et al. ..... 415/1
2004/0062658 A1 * 4/2004 Beck et al. ..... 417/42

OTHER PUBLICATIONS

Garlow, M.E.: Sensorless Estimation of a Sucker-Rod Pump Downhold Dynacard, Unico, Inc., Aug. 12, 2002.
Everitt, T.A, and Jennings, J.W.: An Improved Finite-Difference Calculation of Downhold Dynamometer Cards for Sucker-Rod Pumps, Paper SPE 18189, SPE Production Engineering (Feb. 1992).
Jansen, P.L. and Lorenz, R.D.: Accuracy Limitations of Velocity and Flux Estimation in Direct Field Oriented Induction Machines, Power Electronics and Applications, 1993, Fifth European Conference on , 1993; 312-318, vol. 4.
Lorenz, R.D. and Lawson, D.B.: A Simplified Approach to Continuous On-Line Tuning of Field-Oriented Induction Machine Drives, IEEE Transactions on Industry Applications, vol. 26, No. 3, May/Jun. 1990.
Hasan, A.R. and Kabir, C.S.: Fluid Flow and Heat Transfer in Wellbores, Society of Petroleum Engineers, Richardson, TX, 2002.

* cited by examiner

20

60

260

80

90

100

130

150

CONTROL SYSTEM FOR CENTRIFUGAL PUMPS

CROSS REFERENCE TO RELATED APPLICATIONS

This application claims priority of provisional application Ser. No. 60/429,158, entitled "Sensorless Control System For Progressive Cavity and Electric Submersible Pumps", which was filed on Nov. 26, 2002, and provisional application Ser. No. 60/414,197, entitled "Rod Pump Control System Including Parameter Estimator", which was filed on Sep. 27, 2002, and is related to application Ser. No. 10/655,778, entitled "Control System For Progressing Cavity Pumps", which was filed on Sep. 5, 2003, and application Ser. No. 10/655,777, entitled "Rod Pump Control System Including Parameter Estimator", which was filed on Sep. 5, 2003, which four patent applications are hereby incorporated herein by reference.

BACKGROUND OF THE INVENTION

Field of the Invention

The present invention relates generally to pumping systems, and more particularly, to methods for determining operating parameters and optimizing the performance of centrifugal pumps, which are rotationally driven and characterized by converting mechanical energy into hydraulic energy through centrifugal activity.

Centrifugal pumps are used for transporting fluids at a desired flow and pressure from one location to another, or in a recirculating system. Examples of such applications include, but are not limited to: oil, water or gas wells, irrigation systems, heating and cooling systems, multiple pump systems, wastewater treatment, municipal water treatment and distribution systems.

In order to protect a pump from damage or to optimize the operation of a pump, it is necessary to know and control various operating parameters of a pump. Among these are pump speed, pump torque, pump efficiency, fluid flow rate, minimum required suction head pressure, suction pressure, and discharge pressure.

Sensors are frequently used to directly measure pump operating parameters. In many applications, the placement required for the sensor or sensors is inconvenient or difficult to access and may require that the sensor(s) be exposed to a harmful environment. Also, sensors add to initial system cost and maintenance cost as well as decreasing the overall reliability of the system.

Centrifugal pumping systems are inherently nonlinear. This presents several difficulties in utilizing traditional closed-loop control algorithms, which respond only to error between the parameter value desired and the parameter value measured. Also, due to the nature of some sensors, the indication of the measured parameter suffers from a time delay, due to averaging or the like. Consequently, the non-linearity of the system response and the time lag induced by the measured values makes tuning the control loops very difficult without introducing system instability. As such, it would be advantageous to predict key pump parameters and utilize each in a feed forward control path, thereby improving controller response and stability and reducing sensed parameter time delays.

As an example, in a methane gas well, it is typically necessary to pump water off to release trapped gas from an underground formation. This process is referred to as dewatering, where water is a byproduct of the gas production. The pump is operated to control the fluid level within the well, thereby maximizing the gas production while minimizing the energy consumption and water byproduct.

As another example, in an oil well, it is desirable to reduce the fluid level above the pump to lower the pressure in the casing, thereby increasing the flow of oil into the well and allowing increased production. This level is selected to reduce the level as much as possible while still providing sufficient suction pressure at the pump inlet. The minimum required suction head pressure of a pump is a function of its design and operating point.

Typically, centrifugal pumps are used for both oil and gas production. Generally, the fluid level is sensed with a pressure sensor inserted near the intake or suction side of the pump, typically 1000 to 5000 feet or more below the surface. These down-hole sensors are expensive and suffer very high failure rates, necessitating frequent removal of the pump and connected piping to facilitate repairs.

As fluid is removed, the level within the well drops until the inflow from the formation surrounding the pump casing equals the amount of fluid being pumped out. The pump flow rate may be reduced to prevent the fluid level from dropping too far. At a given speed and flow, there is a minimum suction pressure which must be met or exceeded to prevent a condition that could be damaging to the pump.

Accordingly, it is common practice to monitor the fluid level within the well and control the operation of the pump to prevent damage. This requires the use of downhole sensors.

Downhole sensors are characterized by cost, high maintenance and reliability problems. Likewise, the need for surface flow sensors adds cost to the pump system. The elimination of a single sensor improves the installation cost, maintenance cost and reliability of the system.

Also, centrifugal pumps are inefficient when operating at slow speeds and/or flows, wasting electrical power. Therefore, there is a need for a method which would provide reduced flow without sacrificing overall efficiency.

Accordingly, it is an objective of the invention to provide a method for estimating the flow and pressure of a centrifugal pump without the use of down hole sensors. Another objective of the invention is to provide a method for determining pump suction pressure and/or fluid levels in the pumping system using the flow and pressure of a centrifugal pump combined with other pumping system parameters. Another objective of the invention is to provide a method for using closed loop control of suction pressure or fluid level to protect the pump from damage due to low or lost flow. Another objective of the invention is to provide a method for improving the dynamic performance of closed loop control of the pumping system. Other objectives of the invention are to provide methods for improving the operating flow range of the pump, for using estimated and measured system parameters for diagnostics and preventive maintenance, for increasing pumping system efficiency over a broad range of flow rates, and for automatically controlling the casing fluid level by adjusting the pump speed to maximize gas production from coal bed methane wells.

The apparatus of the present invention must also be of construction which is both durable and long lasting, and it should also require little or no maintenance by the user throughout its operating lifetime. In order to enhance the market appeal of the apparatus of the present invention, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, there is provided a method of continuously determining operational parameters of a down hole pump used in oil, water or gas production. In one embodiment, wherein the pump is a centrifugal pump, the pump is rotationally driven by an AC electrical drive motor having a rotor coupled to the pump for rotating the pump element. In deep wells, it is common practice to use an AC electrical drive motor designed to operate at voltages that are several times that of conventional industrial motors. This allows the motors to operate at lower currents, thereby reducing losses in the cable leading from the surface to the motor. In those cases, a step up transformer can be used at the surface to boost the typical drive output voltages to those required by the motor.

The method comprises the steps of continuously measuring above ground the electrical voltages applied to the cable leading to the drive motor to produce electrical voltage output signals; continuously measuring above ground the electrical currents applied to the drive motor through the cable to produce electrical current output signals; using a mathematical model of the cable and motor to derive values of instantaneous electrical torque from the electrical voltage output signals and the electrical current output signals; using a mathematical model of the cable and motor to derive values of instantaneous motor velocity from the electrical voltage output signals and the electrical current output signals; and using mathematical pump and system models and the instantaneous motor torque and velocity values to calculate instantaneous values of operating parameters of the centrifugal pump system. In systems using a step up transformer, electrical voltages and currents can be measured at the input to the step up transformer and a mathematical model of the step up transformer can be used to calculate the voltages and currents being supplied to the cable leading to the motor. In one embodiment, the method is used for calculating pump flow rate, head pressure, minimum required suction head pressure, suction pressure, and discharge pressure. In another embodiment, used when accurate calculation of pump flow rate is difficult or impossible, the flow rate is measured above ground in addition to determining the motor currents and motor voltages, and the method is used to calculate head pressure, minimum required suction head pressure, suction pressure, and discharge pressure.

The invention provides a method of deriving pump flow rate and head pressure from the drive motor and pumping unit parameters without the need for external instrumentation, and in particular, down hole sensors. The self-sensing control arrangement provides nearly instantaneous readings of motor velocity and torque which can be used for both monitoring and real-time, closed-loop control of the centrifugal pump. In addition, system identification routines are used to establish parameters used in calculating performance parameters that are used in real-time closed-loop control of the operation of the centrifugal pump.

In one embodiment, wherein the operating parameters are pump head pressure and flow rate, the method includes the steps of using the calculated value of the flow rate at rated speed of the pump under the current operating conditions and the instantaneous value of motor speed to obtain pump efficiency and minimum required suction head pressure. The present invention includes the use of mathematical pump and system models to relate motor torque and speed to pump head pressure, flow rate and system operational parameters. In one embodiment, this is achieved by deriving an estimate of pump head pressure and flow rate from motor currents and voltage measurements which are made above ground. The results are used to control the pump to protect the pump from damage, to estimate system parameters, diagnose pumping system problems and to provide closed-loop control of the pump in order to optimize the operation of the pump. Protecting the pump includes detecting blockage, cavitation, and stuck pump. Comparisons of calculated flow estimates and surface flow measurements can detect excess pump wear, flow blockage, and tubing leaks.

The operation of a centrifugal pump is controlled to enable the pump to operate periodically, such that the pump can achieve a broad average flow range while maintaining high efficiency. This obviates the need to replace a centrifugal pump with another pump, such as a rod beam pump, when fluid level or flow in the well decreases over time. In accordance with another aspect of the invention, a check valve is used to prevent back flow during intervals in which the pump is turned off.

In accordance with a further aspect of the invention, an optimizing technique is used in the production of methane gas wherein it is necessary to pump water off an underground formation to release the gas. The optimizing technique allows the fluid level in the well to be maintained near an optimum level in the well and to maintain the fluid at the optimum level over time by controlling pump speed to raise or lower the fluid level as needed to maintain the maximum gas production.

This is done by measuring and/or calculating fluid flow, gas flow, casing gas pressure, and fluid discharge pressure at the surface. Selected fluid levels are used to define a sweet zone. This can be done manually or using a search algorithm. The search algorithm causes the fluid level to be moved up and down, searching for optimum performance. The search algorithm can be automatically repeated at preset intervals to adjust the fluid level to changing well conditions.

Uses of the self-sensing pump control system also include, but are not limited to HVAC systems, multi-pump control, irrigation systems, wastewater systems, and municipal water systems.

DESCRIPTION OF THE DRAWINGS

These and other advantages of the present invention are best understood with reference to the drawings, in which.

Variables used throughout the drawings have the following form: A variable with a single subscript indicates that the reference is to an actual element of the system as in Tm for the torque of the motor or a value that is known in the system and is stable as in Xp for the depth of the pump. A variable with a second subscript of 'm', as in Vmm for measured motor voltage, indicates that the variable is measured on a real-time basis. Similarly, a second subscript of 'e' indicates an estimated or calculated value like Tme for estimated motor torque; a second subscript of 'c' indicates a command like Vmc for motor voltage command; and a second subscript of 'f' indicates a feedforward command like Umf for motor speed feedforward command. Variables in bold type, as in Vs for stator voltage, are vector values having both magnitude and direction.

DETAILED DESCRIPTION OF THE PREFERRED EMBODIMENT

Figure 1:
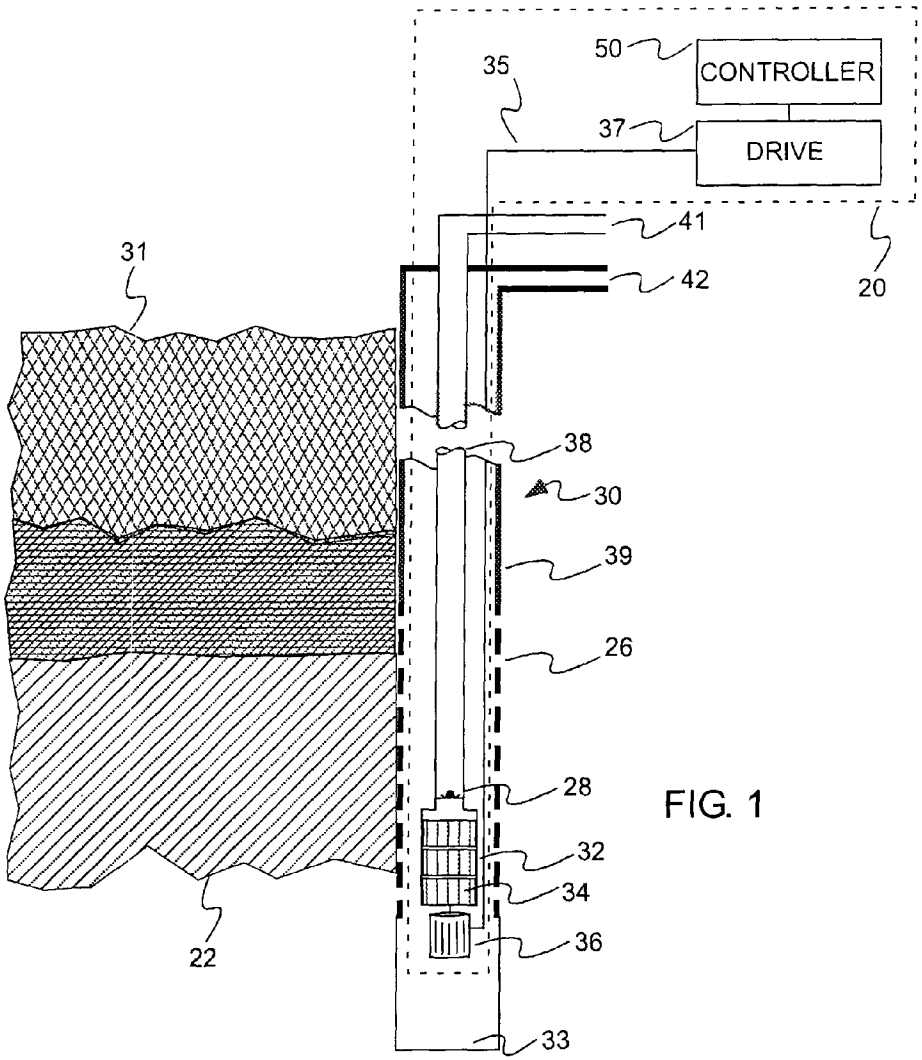
FIG. 1 is a simplified representation of a well including a centrifugal pump, the operation of which is controlled by a pump control system in accordance with the present invention.

Referring to FIG. 1, the present invention is described with reference to an oil well 30 wherein oil is to be pumped from an underground formation 22. The well includes an outer casing 39 and an inner tube 38 that extend from ground level to as much as 1000 feet or more below ground level. The casing 39 has perforations 26 to allow the fluid in the underground formation to enter the well bore. It is to be understood that water and gas can be combined with oil and the pump can be used for other liquids. The control apparatus can also be used for pumping water only. The bottom of the tube generally terminates below the underground formations.

A centrifugal pump of the type known as an electric submersible pump (ESP) 32 is mounted at the lower end of the tube 38 and includes one or more centrifugal pump members 34 mounted inside a pump housing. The pump members are coupled to and driven by a drive motor 36 which is mounted at the lower end of the pump housing. The tube 38 has a liquid outlet 41 and the casing 39 has a gas outlet 42 at the upper end above ground level 31. An optional check valve 28 may be located on the discharge side of the pump 32 to reduce back flow of fluid when the pump is off. These elements are shown schematically in FIG. 1.

The operation of the pump 32 is controlled by a pump control system and method including a parameter estimator in accordance with the present invention. For purposes of illustration, the pump control system 20 is described with reference to an application in a pump system that includes a conventional electric submersible pump. The electric submersible pump includes an electric drive system 37 connected to motor 36 by motor cables 35. A transformer (not shown) is sometimes used at the output of the drive to increase voltage supplied to the motor. The motor rotates the pump elements that are disposed near the bottom 33 of the well. The drive 37 receives commands from controller 50 to control its speed. The controller 50 is located above ground and contains all the sensors and sensor interface circuitry and cabling necessary to monitor the performance of the pump system.

The motor 36 can be a three-phase AC induction motor designed to be operated from line voltages in the range of 230 VAC to several thousand VAC and developing 5 to 500 horsepower or higher, depending upon the capacity and depth of the pump.

Pump Control System

Figure 2:
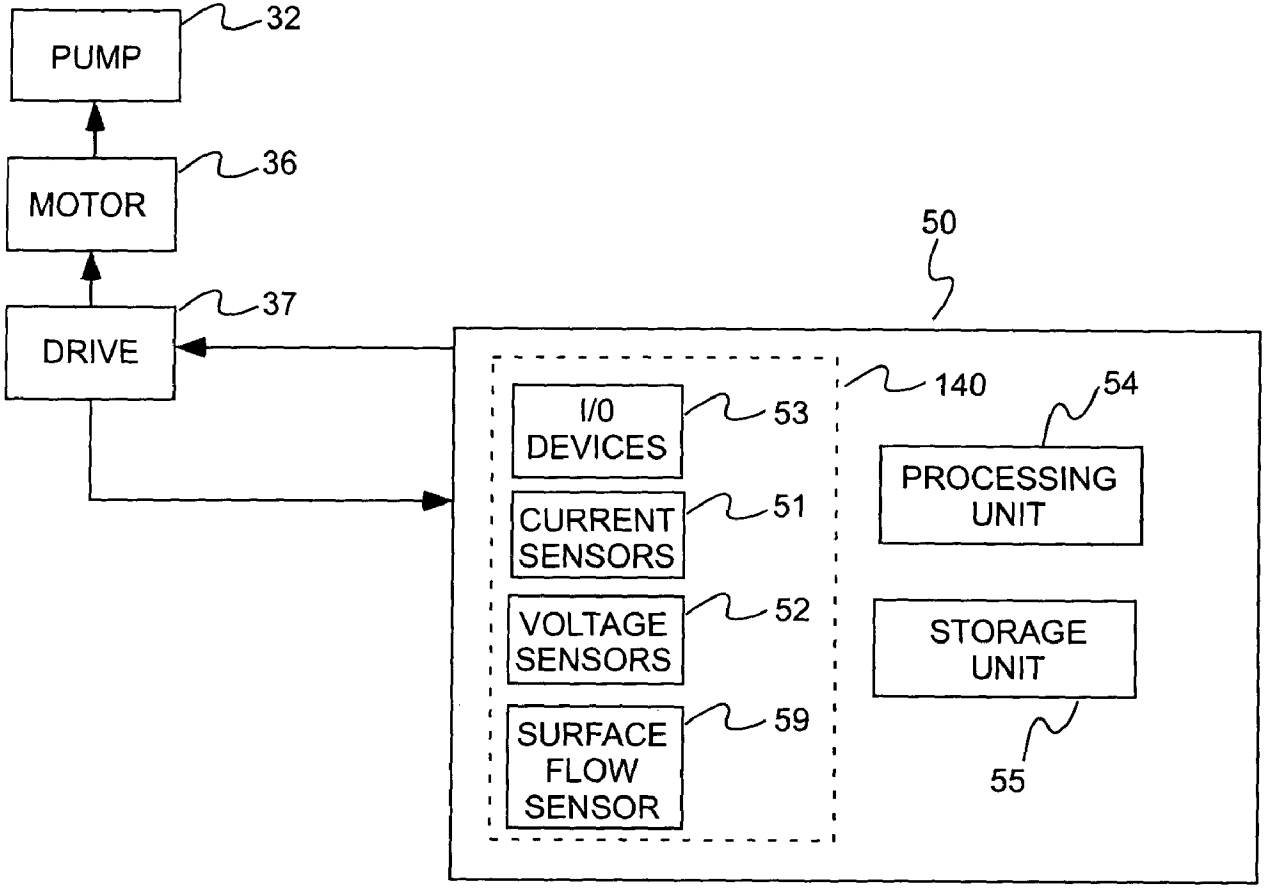
FIG. 2 is a block diagram of the centrifugal pump control system of FIG. 1.

Referring to FIG. 2, there is shown a simplified representation of the pump control system 20 for the pump 32. The pump control system 20 controls the operation of the pump 32. In one embodiment, the casing fluid level is estimated using pump flow rate and head pressure estimates which, in turn, can be derived from values of motor speed and torque estimates. The pump flow rate and head pressure estimates are combined with system model parameters to produce a casing fluid level estimate. In one preferred embodiment, a pump model and system model are used to produce estimated values of pump flow rate and casing fluid level for use by a pump controller in producing drive control signals for the pump 32.

Alternatively, the measured discharge flow rate of the pump 32 can be obtained using measurements from the surface flow sensor 59 and combined with the estimates produced by the pump and system models to produce the casing fluid level estimate. This is particularly useful when the configuration of the pump makes it difficult to accurately calculate pump flow rate from the mechanical inputs to the pump.

While in a primary function the estimated parameters are used for control, the parameters also can be used for other purposes. For example, the estimated parameters can be compared with those measured by sensors or transducers for providing diagnostics alarms. The estimated parameters may also be displayed to setup, maintenance or operating personnel as an aid to adjusting or troubleshooting the system.

In one embodiment, values of flow and pressure parameters are derived using measured or calculated values of instantaneous motor currents and voltages, together with pump and system parameters, without requiring down hole sensors, fluid level meters, flow sensors, etc. The flow and pressure parameters can be used to control the operation of the pump 32 to optimize the operation of the system. In addition, pump performance specifications and system identification routines are used to establish parameters used in calculating performance parameters that are used in real time closed-loop control of the operation of the pump.

The pump control system 20 includes transducers, such as above ground current and voltage sensors, to sense dynamic variables associated with motor load and velocity. The pump control system further includes a controller 50, a block diagram of which is shown in FIG. 2. Above ground current sensors 51 of interface devices 140 are coupled to a sufficient number of the motor cables 35, two in the case of a three phase AC motor. Above ground voltage sensors 52 are connected across the cables leading to the motor winding inputs. The current and voltage signals produced by the sensors 51 and 52 are supplied to a processing unit 54 of the controller 50 through suitable input/output devices 53. The controller 50 further includes a storage unit 55 including storage devices which store programs and data files used in calculating operating parameters and producing control signals for controlling the operation of the pump system. This self-sensing control arrangement provides nearly instantaneous estimates of motor velocity and torque, which can be used for both monitoring and real-time, closed-loop control of the pump. For example, in one embodiment, instantaneous estimates of motor velocity and torque used for real-time, closed-loop control are provided at the rate of about 1000 times per second.

Motor currents and voltages are sensed or calculated to determine the instantaneous speed and torque produced by the electric motor operating the pump. As the centrifugal pump 32 is rotated, the motor 36 is loaded. By monitoring the motor currents and voltages above ground, the calculated torque and speed produced by the motor 36, which may be below ground, are used to calculate estimates of fluid flow and head pressure produced by the pump 32.

More specifically, interface devices 140 include the devices for interfacing the controller 50 with the outside world. None of these devices are located below ground. Sensors in blocks 51 and 52 can include hardware circuits which convert and calibrate the current and voltage signals into current and flux signals. After scaling and translation, the outputs of the voltage and current sensors can be digitized by analog to digital converters in block 53. The processing unit 54 combines the scaled signals with cable and motor equivalent circuit parameters stored in the storage unit 55 to produce a precise calculation of motor torque and motor velocity. Block 59 contains an optional surface flow meter which can be used to measure the pump flow rate. Block 59 may also contain signal conditioning circuits to filter and scale the output of the flow sensor before the signal is digitized by analog to digital converters in block 53.

Pump Control

Figure 3:
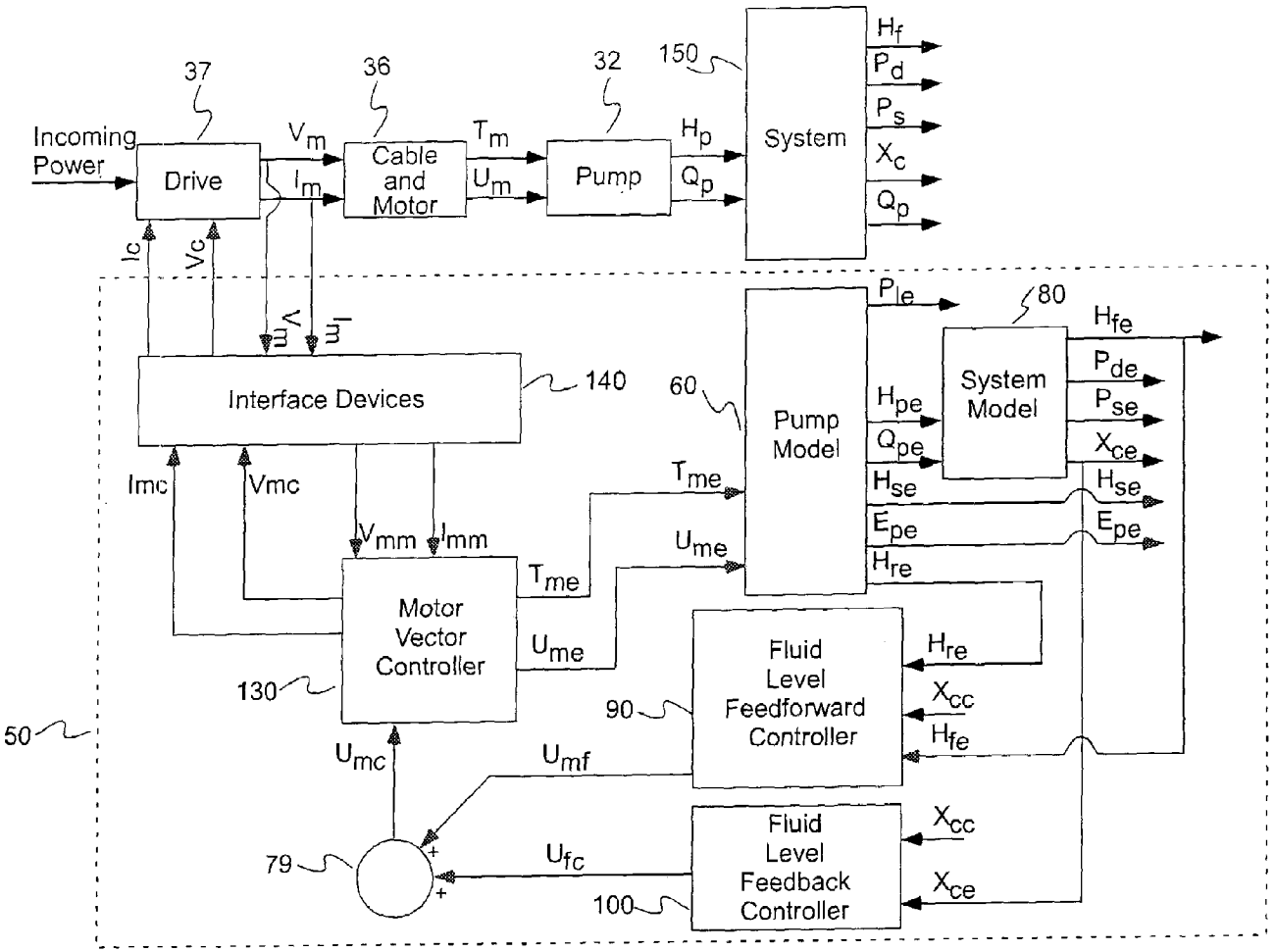
FIG. 3 is a functional block diagram of a pump control system for the centrifugal pump of FIG. 1 when using estimated flow.

Referring to FIG. 3, which is a functional block diagram of the pump control system 20 for a pump 32 where the pump flow rate to pump power relationship allows pump flow rate to be calculated, the pump 32 is driven by a drive 37 and motor 36 to transfer fluid within a system 150. The operation of the motor 36 is controlled by the drive 37 and controller 50 which includes a pump model 60, system model 80, fluid level feedforward controller 90, fluid level feedback controller 100, motor vector controller 130 and interface devices 140.

More specifically, block 140, which is located above ground, can include hardware circuits which convert and calibrate the motor current signals Im (consisting of individual phase current measurements Ium and Ivm in the case of a three phase motor) and voltage signals Vm (consisting of individual phase voltage measurements Vum, Vvm, and Vwm in the case of a three phase motor) into motor current and flux signals. After scaling and translation, the outputs of the voltage and current sensors can be digitized by analog to digital converters into measured voltage signals Vmm and measured current signals Imm. The motor vector controller 130 combines the scaled signals with cable and motor equivalent circuit parameters to produce a precise calculation of motor electrical torque Tme and velocity Ume. Automatic identification routines can be used to establish the cable and motor equivalent circuit parameters.

Figure 13:
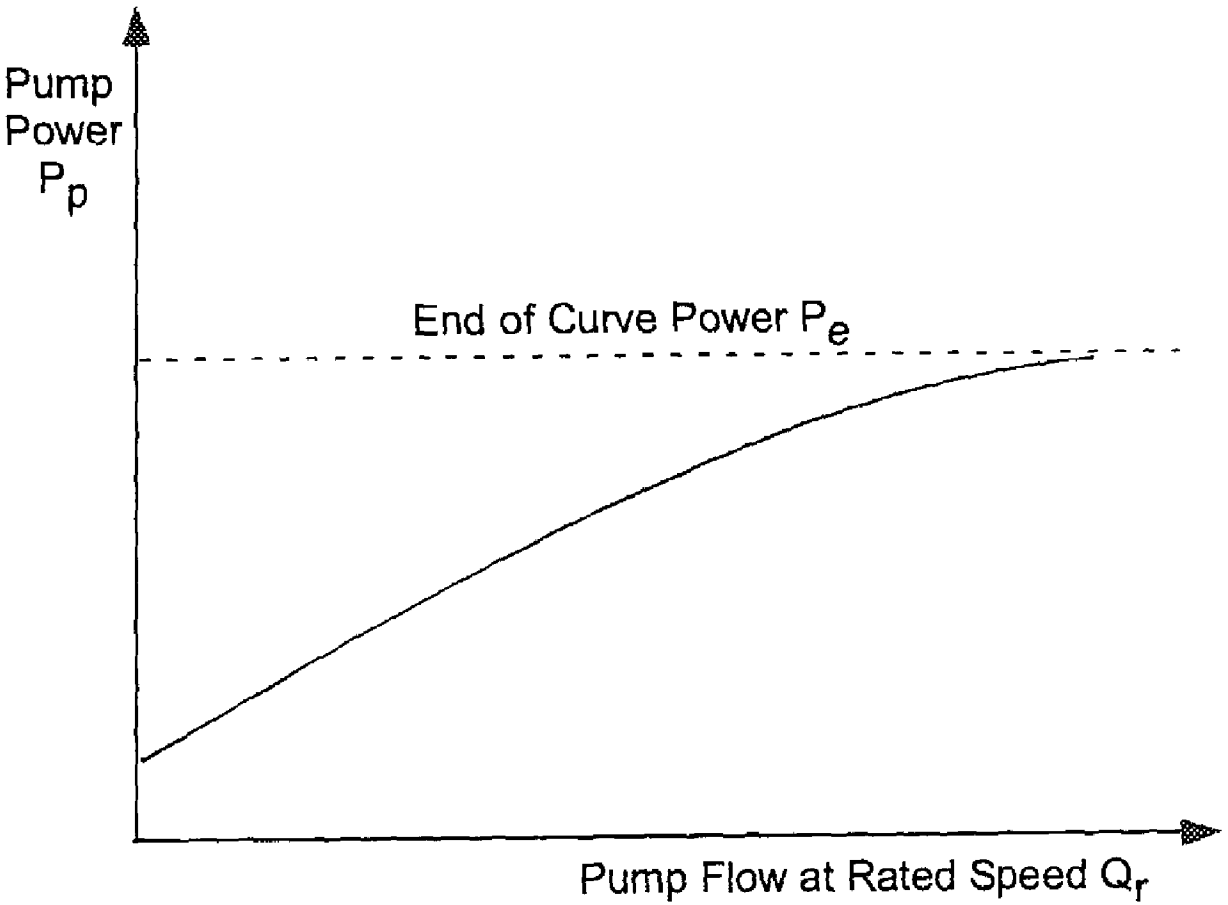

The pump model 60 calculates the values of parameters, such as pump flow rate Qpe, pump head pressure Hpe, pump head pressure at rated speed Hre, minimum required suction head pressure Hse, pump efficiency Epe, and pump safe power limit Ple relating to operation of the pump 32 from inputs corresponding to motor torque Tme and motor speed Ume without the need for external flow or pressure sensors. This embodiment is possible for pumps where the relationship of pump flow rate to pump power at rated speed, as shown in FIG. 13, is such that each value of power has only one unique value of pump flow rate associated with it throughout the range of pump flows to be used. Further, the system model 80 derives estimated values of the pump suction pressure Pse, flow head loss Hfe, pump discharge pressure Pde and the casing fluid level Xce from inputs corresponding to discharge flow rate value Qpe and the head pressure value Hpe of the pump. The fluid level feedforward controller 90 uses the pump head pressure at rated speed value Hre, flow head loss value Hfe and commanded fluid level Xcc to calculate a motor speed feedforward command Umf. The fluid level feedback controller 100 compares the commanded fluid level Xcc with static and dynamic conditions of the fluid level value Xce to calculate a motor velocity feedback command Ufc. Motor velocity feedback command Ufc and feedforward command Umf are added in summing block 79 to yield the motor velocity command Umc.

Motor vector controller 130 uses the motor speed command Umc to generate motor current commands Imc and voltage commands Vmc. Interface devices in block 140, which can be digital to analog converters, convert the current commands Imc and voltage commands Vmc into signals which can be understood by the drive 37. These signals are shown as Ic for motor current commands and Vc for motor winding voltage commands. In installations with long cables and/or step up transformers, the signals Ic and Vc would be adjusted to compensate for the voltage and current changes in these components.

Figure 4:
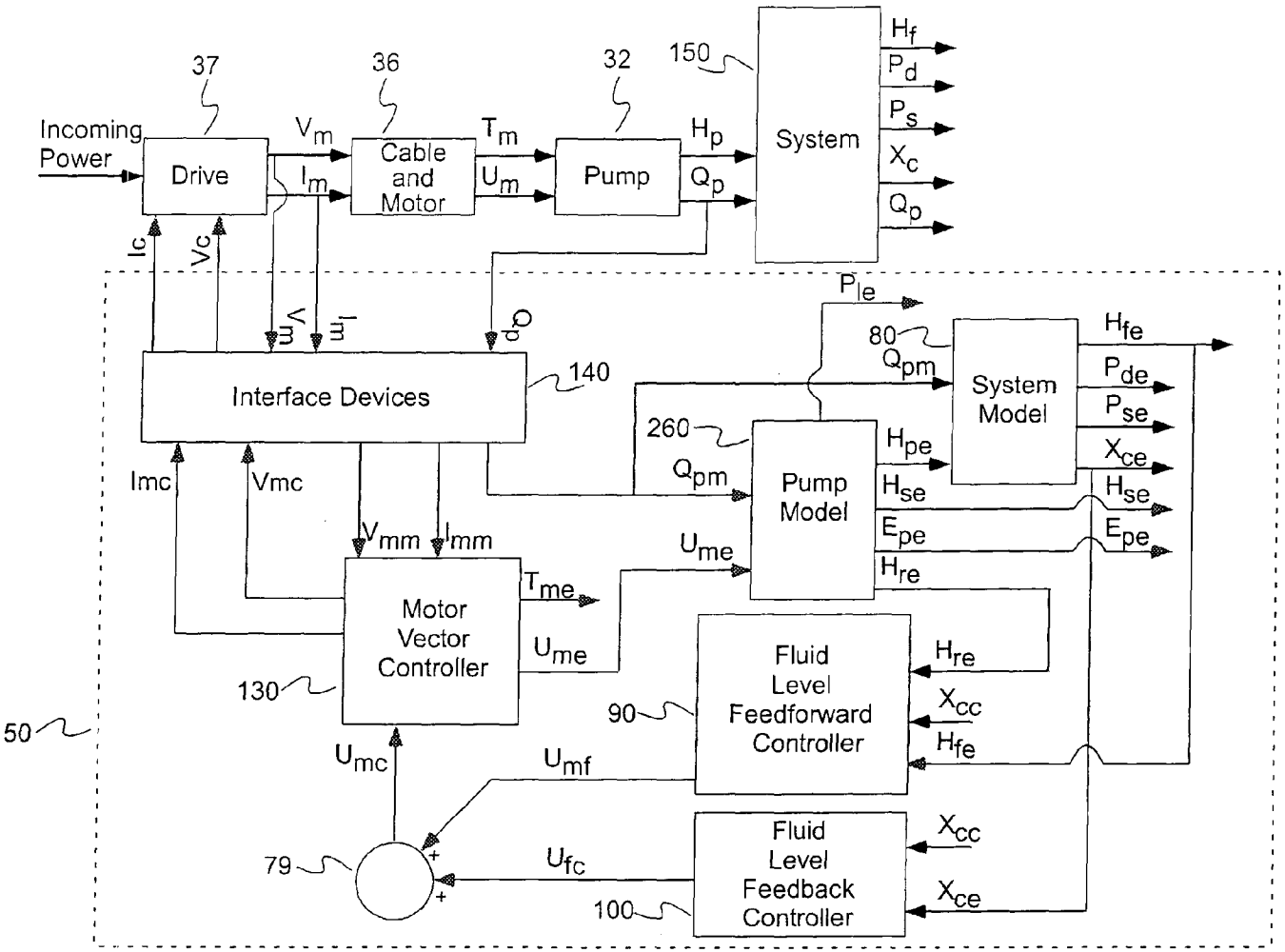
FIG. 4 is a functional block diagram of a pump control system for the centrifugal pump of FIG. 1 when using measured flow.

Referring to FIG. 4, which is a functional block diagram of the pump control system 20 for a pump 32 where the pump flow rate is measured above ground, the pump 32 is driven by a drive 37 and motor 36 to transfer fluid within a system 150. The operation of the motor 36 is controlled by the drive 37 and controller 50 which includes a pump model 260, system model 80, fluid level feedforward controller 90, fluid level feedback controller 100, motor vector controller 130 and interface devices 140.

More specifically, block 140, which is located above ground, can include hardware circuits which convert and calibrate the motor current signals Im (consisting of individual phase current measurements Ium and Ivm in the case of a three phase motor) and voltage signals Vm (consisting of individual phase voltage measurements Vum, Vvm, and Vwm in the case of a three phase motor) into motor current and flux signals. After scaling and translation, the outputs of the voltage and current sensors can be digitized by analog to digital converters into measured voltage signals Vmm and measured current signals Imm. The motor vector controller 130 combines the scaled signals with cable and motor equivalent circuit parameters to produce a precise calculation of motor electrical torque Tme and velocity Ume. Automatic identification routines can be used to establish the cable and motor equivalent circuit parameters.

In this embodiment, block 140 also may contain hardware circuits which convert above ground flow rate into an electrical signal that can be digitized by analog to digital converters into the measured flow signal Qpm for use by the pump model 260 and the system model 80.

The pump model 260 calculates the values of parameters pump head pressure Hpe, pump head pressure at rated speed Hre, minimum required suction head pressure Hse, pump efficiency Epe, and pump safe power limit Ple relating to operation of the pump 32 from inputs corresponding to flow Qpm as measured by a flow sensor and motor speed Ume without the need for other external sensors. This embodiment is used for pumps where the relationship of pump flow rate to pump power at rated speed is such that there is not a unique pump flow rate for each value of pump power. Further, the system model 80 derives estimated values of the pump suction pressure Pse, flow head loss Hfe, pump discharge pressure Pde and the casing fluid level Xce from inputs corresponding to discharge flow rate value Qpm and the head pressure value Hpe of the pump. The fluid level feedforward controller 90 uses the motor speed value Ume, flow head loss value Hfe and commanded fluid level Xcc to calculate a motor speed feedforward command Umf. The fluid level feedback controller 100 compares the commanded fluid level Xcc with static and dynamic conditions of the fluid level value Xce to calculate a motor velocity feedback command Ufc. Motor velocity feedback command Ufc and feedforward command Umf are added in summing block 79 to yield the motor velocity command Umc.

Motor vector controller 130 uses the motor speed command Umc to generate motor current commands Imc and voltage commands Vmc. Interface devices in block 140, which can be digital to analog converters, convert the current commands Imc and voltage commands Vmc into signals which can be understood by the drive 37. These signals are shown as Ic for motor current commands and Vc for motor winding voltage commands. In installations with long cables and/or step up transformers, the signals Ic and Vc would be adjusted to compensate for the voltage and current changes in these components.

The controller 50 provides prescribed operating conditions for the pump and/or system. To this end, either pump model 60 or pump model 260 also can calculate the efficiency Epe of the pump for use by the controller 50 in adjusting operating parameters of the pump 32 to determine the fluid level Xc needed to maximize production of gas or produced fluid and/or the fluid level Xc needed to maximize production with a minimum power consumption.

Figure 8:
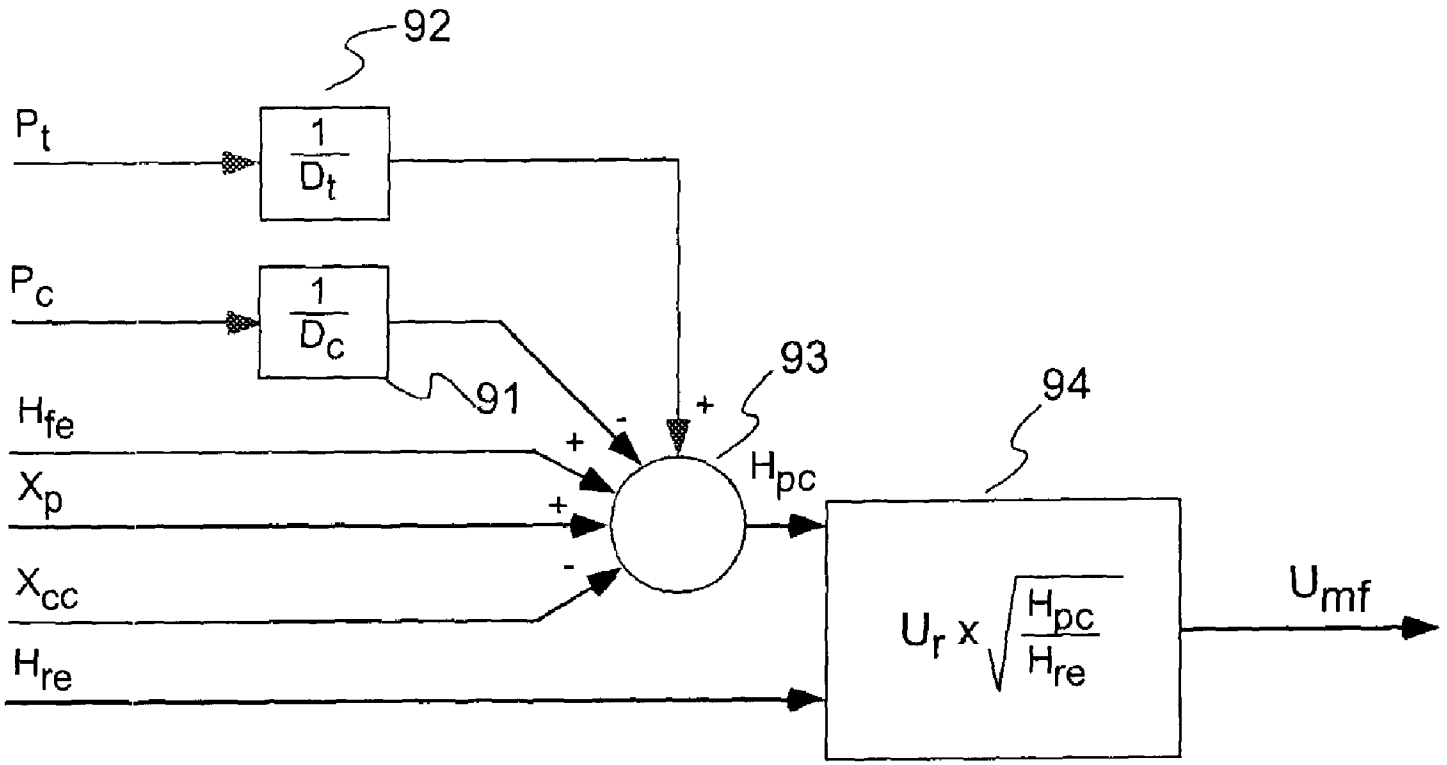
FIG. 8 is a block diagram of an algorithm for a fluid level feedforward controller of the centrifugal pump control system of FIGS. 3 and 4.

The controller 50 (FIG. 3 and FIG. 4) uses the parameter estimates to operate the pump so as to minimize energy consumption, optimize gas flow, and maintain the fluid level to accomplish the objectives. Other inputs supplied to the controller 50 include the commanded casing fluid level Xcc and values representing casing pressure Pc and tubing pressure Pt (FIG. 8). Values representing casing pressure Pc and tubing pressure Pt may each be preset to approximate values as part of the system setup or, as is preferable in situations where these values are likely to vary during operation of the system, the controller 50 can use values measured by sensors mounted above ground and connected to the controller 50 through appropriate signal conditioning and interface circuitry.

The controller 50 (FIG. 3 and FIG. 4) optimizes use of electrical power as the flow delivery requirements change and can determine fluid level without using down hole sensors and, in one preferred embodiment, without using surface flow sensors. As will be shown, the control operations provided by the controller 50 include the use of the pump model 60 (FIG. 3) or pump model 260 (FIG. 4) and system model 80 (FIG. 3 or FIG. 4) to relate mechanical pump input to output flow rate and head pressure. In one embodiment (FIG. 3), this is achieved by deriving an estimate of pump flow rate from above ground measurements of motor current and voltage. In another embodiment (FIG. 4), the pump flow rate is measured using a surface flow sensor. From the flow value thus obtained, the pump head pressure, efficiency and other pump operating parameters are determined using pump curve data. The results are used to control the pump 32 to protect it from damage and to provide closed-loop control of the pump 32 in order to optimize the operation of the pumping system. Protecting the pump 32 includes detecting blockage, cavitation, and stuck pump.

Moreover, the operation of the pump 32 can be controlled to enable it to operate periodically, such that the pump can operate efficiently at a decreased average pump flow rate. This obviates the need to replace the electric submersible pump with another pump, such as a rod beam pump, when fluid level or inflow within the well decreases over time.

Further, in accordance with the invention, the pump can be cycled between its most efficient operating speed and zero speed at a variable duty cycle to regulate average pump flow rate. Referring to FIG. 1, in cases where electric submersible pumps are being operated at a low duty cycle, such as on for twenty-five percent of the time and off for seventy-five percent of the time, a check valve 28 may be used down hole to prevent back flow of previously pumped fluid during the portion of each cycle that the pump is off. The check valve 28 can be designed to allow a small amount of leakage. This allows the fluid to slowly drain out of the tube 38 to allow maintenance operations.

Pump Model

Figure 5:
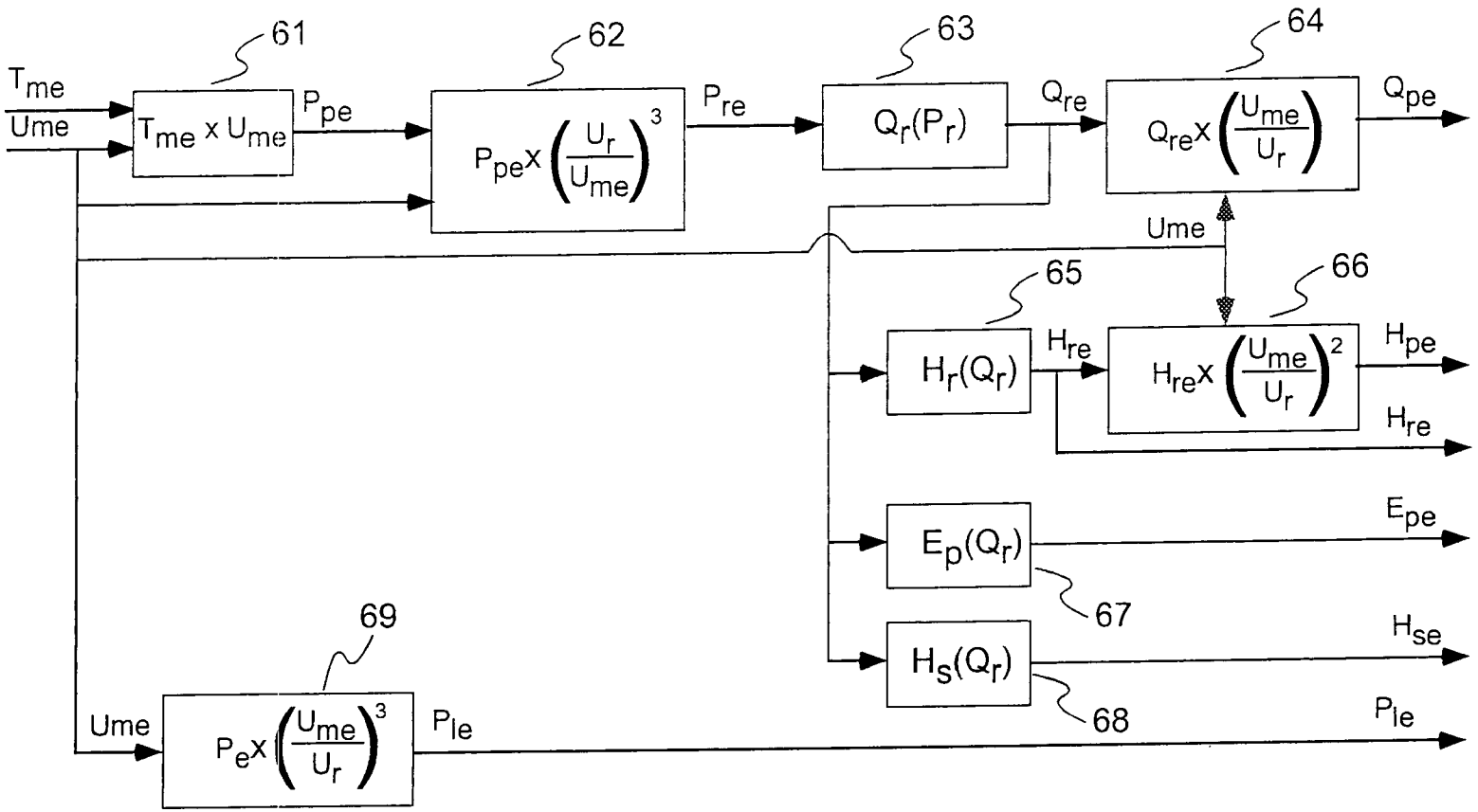
FIG. 5 is a block diagram of an algorithm for a pump model of the centrifugal pump control system of FIG. 3.

Reference is now made to FIG. 5, which is a block diagram of an algorithm for the pump model 60 of the pump 32 as used in the embodiment shown in FIG. 3 where it is possible to calculate an estimate of pump flow rate. The pump model 60 is used to calculate estimates of parameters including head pressure Hpe, fluid flow Qpe, minimum required suction head pressure Hse, pump mechanical input power limit Ple, and pump efficiency Epe. In one preferred embodiment, the calculations are carried out by the processing unit 54 (FIG. 2) under the control of software routines stored in the storage devices 55 (FIG. 2). Briefly, values of motor torque Tme and motor speed Ume are used to calculate the mechanical power input to the pump Ppe which is used with the motor speed value Ume to calculate what the flow Qre would be at rated pump speed Ur. This value of Qre is used with formulas derived from published pump data and pump affinity laws to solve for the pump head at rated speed Hre, pump efficiency Epe, and minimum required suction head pressure required Hse. Using the value of motor speed Ume, the values of pump head at rated speed Hre and pump flow rate at rated speed Qre are scaled using pump affinity laws to estimated values of pump head Hpe and pump flow rate Qpe, respectively.

With reference to the algorithm illustrated in FIG. 5, the value for pump mechanical input power Ppe is obtained by multiplying the value for motor torque Tme by the value of motor speed Ume in block 61. In block 62, the mechanical input power applied to the pump, Ppe is multiplied by a scaling factor calculated as the cube of the ratio of the rated speed of the pump Ur to the current speed Ume to yield a value representing the power Pre which the pump would require at rated pump speedUr. This scaling factor is derived from affinity laws for centrifugal pumps.

Block 63 derives a value of the pump flow rate Qre at the rated speed with the current conditions. This value of pump flow rate Qre at rated speed is calculated as a function of power Pre at rated speedUr. Pump manufacturers often provide pump curves such as the one shown in FIG. 13, which relates pump mechanical input power Pp to flow Qre at rated speed. Alternatively, such a curve can be generated from values of pump head as a function of flow at rated speed, pump efficiency as a function of flow at rated speed, and the fluid density. The function of block 63 (FIG. 5) is derived from the data contained in the graph. One of two methods is used to derive the function of block 63 from the data in this graph. The first method is to select data points and use curve fitting techniques, which are known, to generate an equation describing power as a function of flow. Solving the equation so flow is given as a function of power will provide one method of performing the calculation in block 63. One simple method is to fit the data to a second order equation. In the case of a second order equation, the solution for flow is in the form of a quadratic equation which yields two solutions of flow for each value of power. In this case, block 63 must contain a means of selecting flow value Qre from the two solutions. This is usually easy as one of the values will be much less likely than the other, if not impossible as in a negative flow solution. The second method is to select several points on the graph to produce a look-up table of flow versus power. With such a look-up table, it is relatively easy to use linear interpolation to determine values of Qre between data points.

In block 64, the value for flow at rated speed, Qre, is scaled by the ratio of the current speed Ume to the rated speed Ur to yield the pump flow rate value Qpe. This scaling factor is derived from affinity laws for centrifugal pumps.

Figure 11:
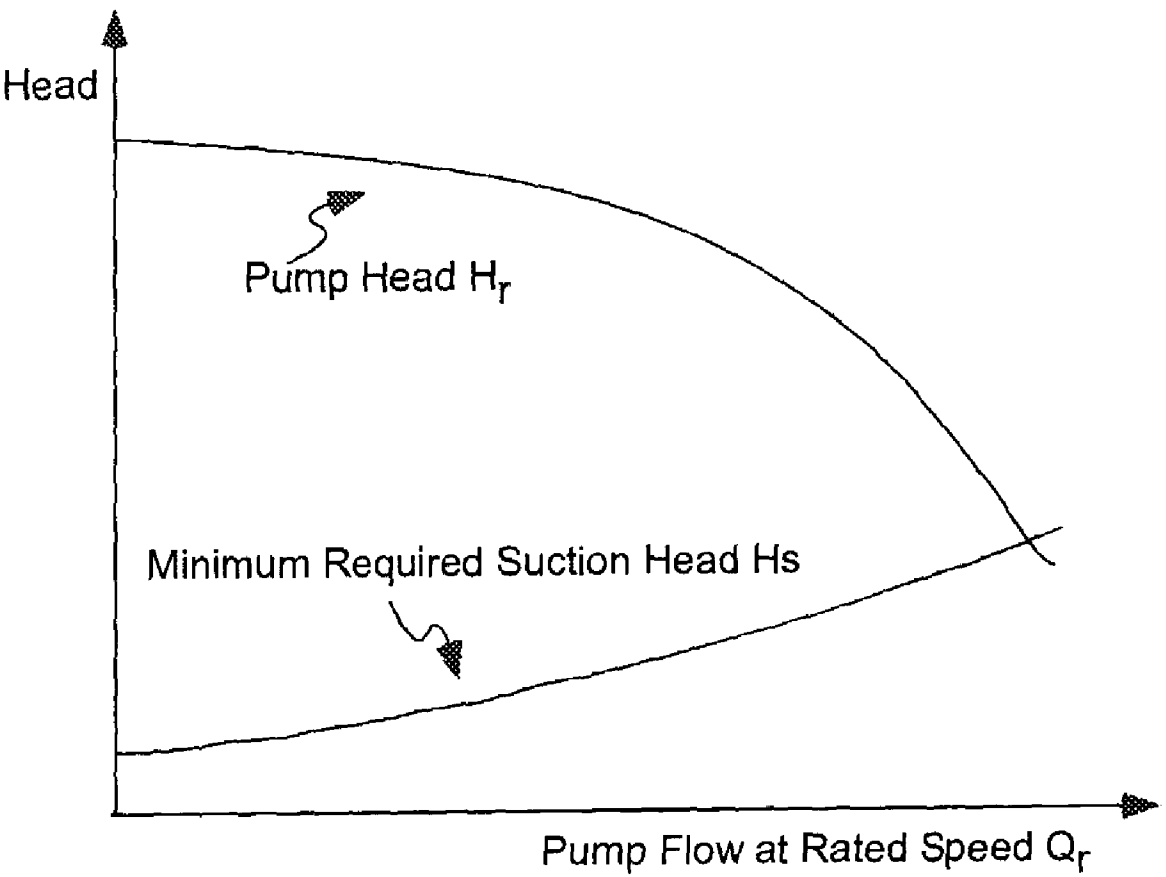
FIGS. 11 through 13 are a set of pump specification curves for a centrifugal pump, illustrating pump power, pump head, pump efficiency and pump suction pressure required wherein each is a function of pump flow rate at rated speed.

Block 65 calculates a value of head pressure at rated speed Hre as a function of flow at rated speed Qre. Pump manufacturers provide pump curves such as the one shown in FIG. 11, which relates pump head pressure to flow at rated speed. The function of block 65 is uses the data contained in the graph. One of two methods is used to derive the function of block 65 from the data in this graph. The first method is to select data points and use curve fitting techniques, which are known, to generate an equation describing pump head pressure as a function of flow. The second method is to select several points on the graph to produce a look-up table of pump head pressure versus flow. With such a look-up table, it is relatively easy to use linear interpolation to determine values of Hre between data points. In block 66, the value for pump head pressure at rated speed, Hre, is scaled by the square of ratio of the current speed Ume to the rated speed Ur to yield the pump head pressure value Hpe. This scaling factor is derived from affinity laws for centrifugal pumps.

Figure 12:
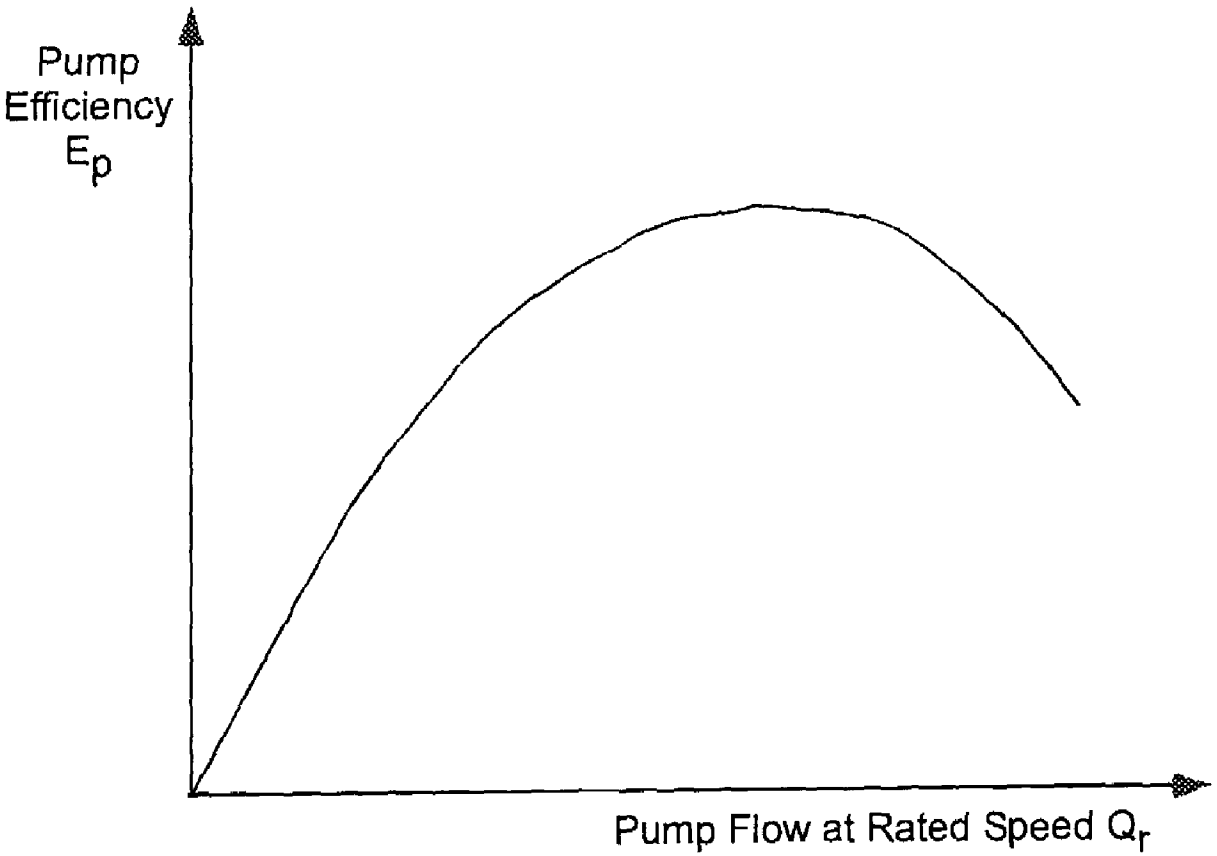

The efficiency of the pump is calculated in block 67 to yield the value Epe. Pump efficiency is the ratio of fluid power output divided by mechanical power input. Pump manufacturers provide pump curves such as the one shown in FIG. 12, which relates pump efficiency to pump flow rate at rated speed. The function of block 67 is derived from the data contained in the graph. One of two methods is used to derive the function of block 67 from the data in this graph. The first method is to select data points and use curve fitting techniques, which are known, to generate an equation describing pump efficiency as a function of flow. The second method is to select several points on the graph to produce a look-up table of pump efficiency versus flow. With such a look-up table, it is relatively easy to use linear interpolation to determine values of Epe between data points.

An estimate of the suction head pressure required at the input of the pump, Hse, is calculated in block 68. Pump manufacturers provide pump curves such as the one shown in FIG. 11, which relates the pump's minimum required suction head pressure Hs to pump flow rate at rated speed. The function of block 68 is derived from the data contained in the graph. One of two methods is used to derive the function of block 68 from the data in this graph. The first method is to select data points and use curve fitting techniques, which are known, to generate an equation describing pump suction pressure required as a function of flow. The second method is to select several points on the graph to produce a look-up table of pump suction pressure required versus pump flow rate. With such a look-up table, it is relatively easy to use linear interpolation to determine values of Sre between data points.

A mechanical input power limit for the pump is calculated in block 69. The end of curve power level Pe as shown in FIG. 13 is scaled by the cube of the ratio of the current speed Ume to the rated speed Ur to provide the mechanical input power limit estimate Ple. This scaling factor is derived from affinity laws for centrifugal pumps. The mechanical input power limit value can be used to limit the torque and/or the speed of the pump, and thereby limit power, to levels which will not damage the pump.

Figure 6:
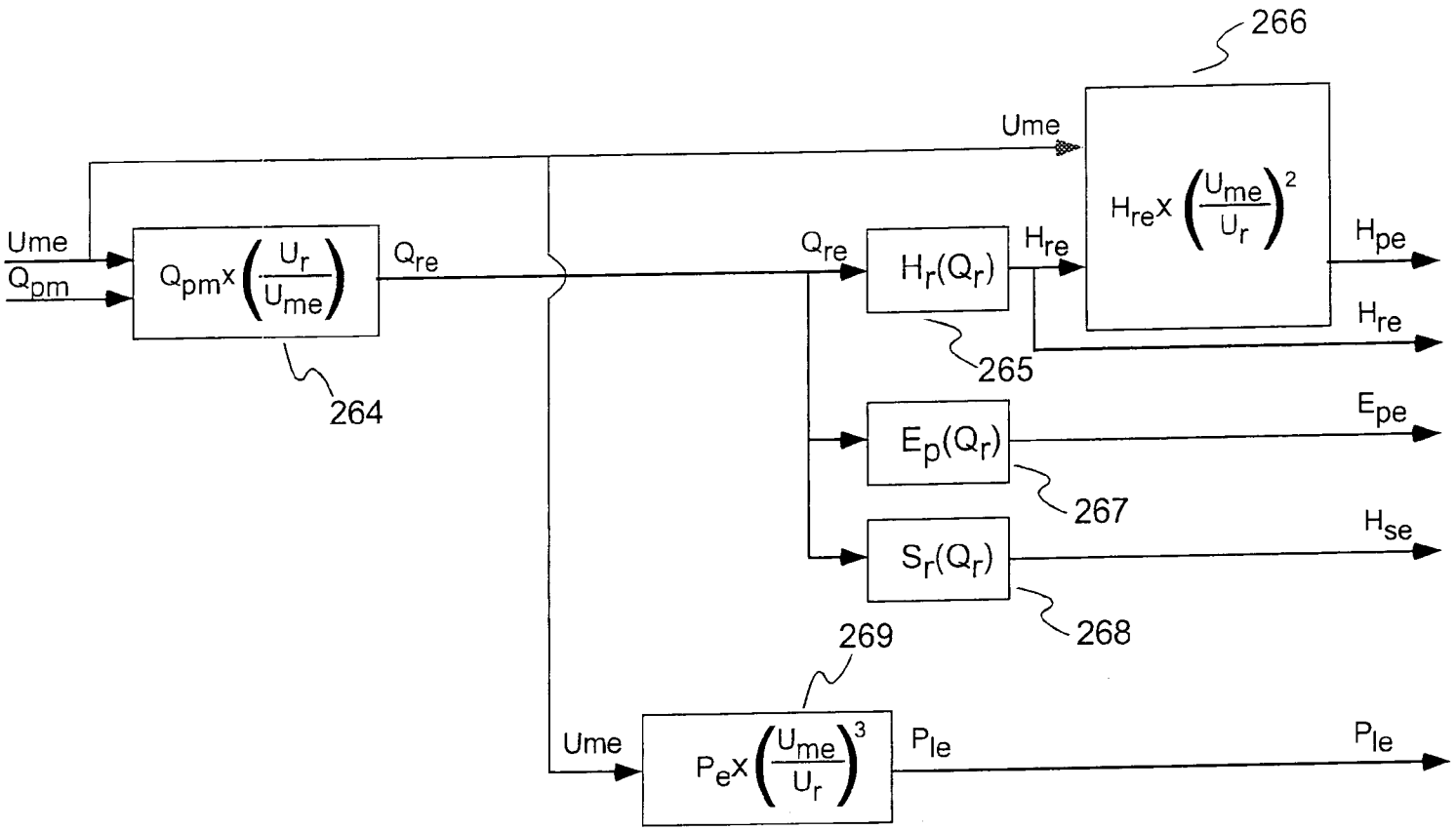
FIG. 6 is a block diagram of an algorithm for a pump model of the centrifugal pump control system of FIG. 4.

Reference is now made to FIG. 6, which is a block diagram of an algorithm for the pump model 260 of the pump 32 as used in the embodiment shown in FIG. 4 where it is not possible to calculate an estimate of pump flow rate. The pump model 260 is used to calculate estimates of parameters including head pressure Hpe, minimum required suction head pressure Hse, pump mechanical input power limit Ple, and pump efficiency Epe. In one preferred embodiment, the calculations are carried out by the processing unit 54 (FIG. 2) under the control of software routines stored in the storage devices 55 (FIG. 2). Briefly, values of measured fluid flow Qpm and motor speed Ume are used to calculate what the flow Qre would be at rated pump speed Ur. This value of flow Qre is used with formulas derived from published pump data and pump affinity laws to solve for the pump head at rated speed Hre, pump efficiency Epe, and minimum required suction head pressure required Hse. Using the value of motor speed Ume, the values of pump head at rated speed Hre and pump flow rate at rated speed Qre are scaled using pump affinity laws to estimated values of pump head Hpe and pump flow rate Qpe respectively.

With reference to the algorithm illustrated in FIG. 6, in block 264, the value for measured pump flow rate Qpm is scaled by the ratio of the rated speed of the pump Ur to the speed of the pump Ume to derive an estimate of the flow of the pump at rated speed Qre. This scaling factor is derived from affinity laws for centrifugal pumps.

Block 265 calculates a value of head pressure at rated speed Hre as a function of flow Qre at rated speed Ur. Pump manufacturers provide pump curves such as the one shown in FIG. 11, which relates pump head pressure to flow at rated speed. The function of block 265 is derived from the data contained in the graph. One of two methods is used to derive the function of block 265 from the data in this graph. The first method is to select data points and use curve fitting techniques, which are known, to generate an equation describing pump head pressure as a function of flow. The second method is to select several points on the graph to produce a look-up table of pump head pressure versus flow. With such a look-up table, it is relatively easy to use linear interpolation to determine values of Hre between data points. In block 266, the value for pump head pressure at rated speed, Hre, is scaled by the square of the ratio of the current speed Ume to the rated speed Ur to yield the pump head pressure value Hpe. This scaling factor is derived from affinity laws for centrifugal pumps.

The efficiency of the pump is calculated in block 267 to yield the value Epe. Pump efficiency is the ratio of fluid power output divided by mechanical power input. Pump manufacturers provide pump curves such as the one shown in FIG. 12, which relates pump efficiency to pump flow rate at rated speed. The function of block 267 is derived from the data contained in the graph. One of two methods is used to derive the function of block 267 from the data in this graph. The first method is to select data points and use curve fitting techniques, which are known, to generate an equation describing pump efficiency as a function of flow. The second method is to select several points on the graph to produce a look-up table of pump efficiency versus flow. With such a look-up table, it is relatively easy to use linear interpolation to determine values of Epe between data points.

An estimate of the suction head pressure required at the input of the pump, Hse, is calculated in block 268. Pump manufacturers provide pump curves such as the one shown in FIG. 11, which relates the pump's minimum required suction head pressure Hs to pump flow rate at rated speed. The function of block 268 is derived from the data contained in the graph. One of two methods is used to derive the function of block 68 from the data in this graph. The first method is to select data points and use curve fitting techniques, which are known, to generate an equation describing pump suction pressure required as a function of flow. The second method is to select several points on the graph to produce a look-up table of pump suction pressure required versus pump flow rate. With such a look-up table, it is relatively easy to use linear interpolation to determine values of Sre between data points.

A mechanical input power limit for the pump is calculated in block 269. The end of curve power level Pe as shown in FIG. 13 is scaled by the cube of the ratio of the current speed Ume to the rated speed Ur to provide the mechanical input power limit estimate Ple. This scaling factor is derived from affinity laws for centrifugal pumps. The mechanical input power limit value Ple can be used to limit the torque and/or the speed of the pump, and thereby limit power, to levels which will not damage the pump.

System Model

Figure 7:
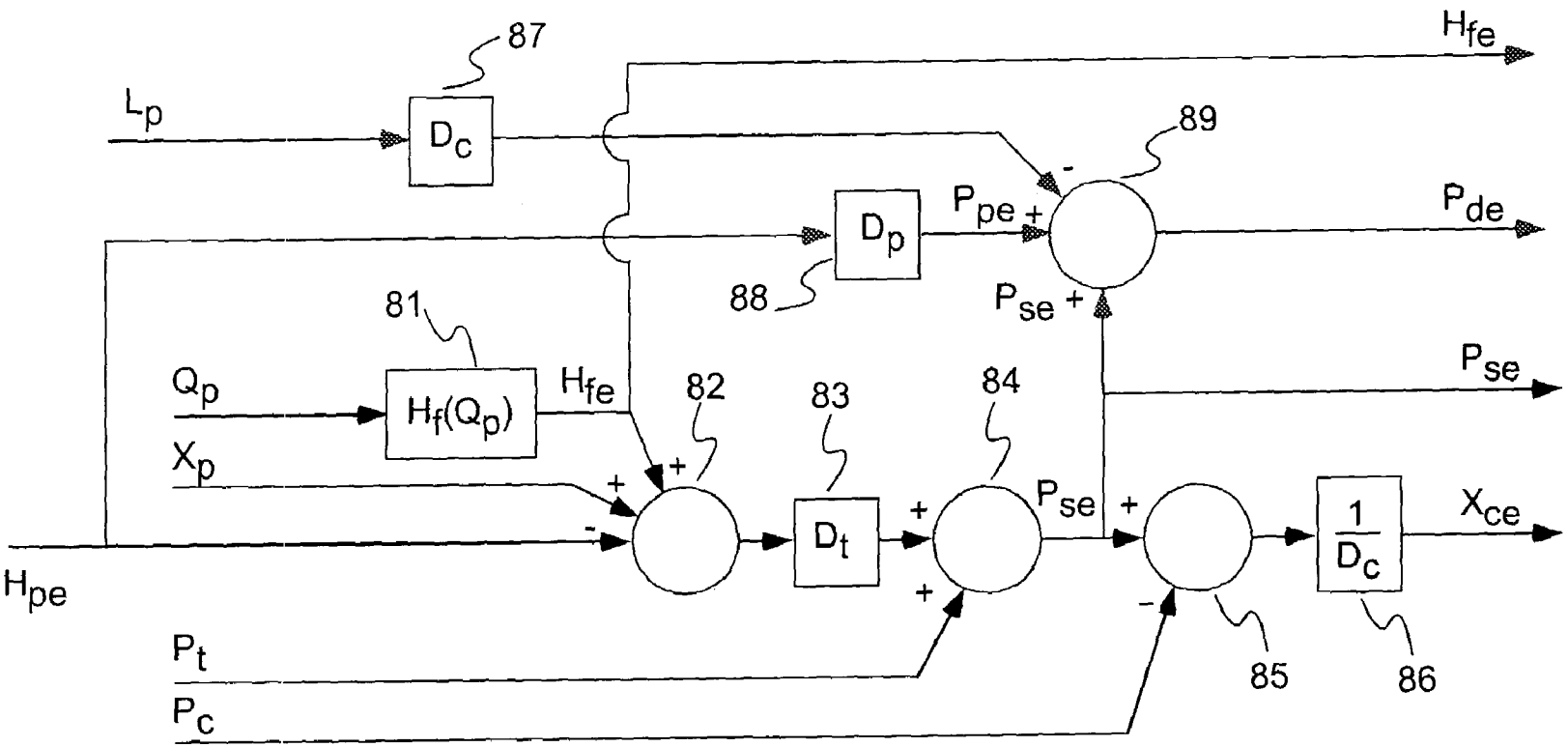
FIG. 7 is a block diagram of an algorithm for a system model of the centrifugal pump control system of FIGS. 3 and 4.
Figure 14:
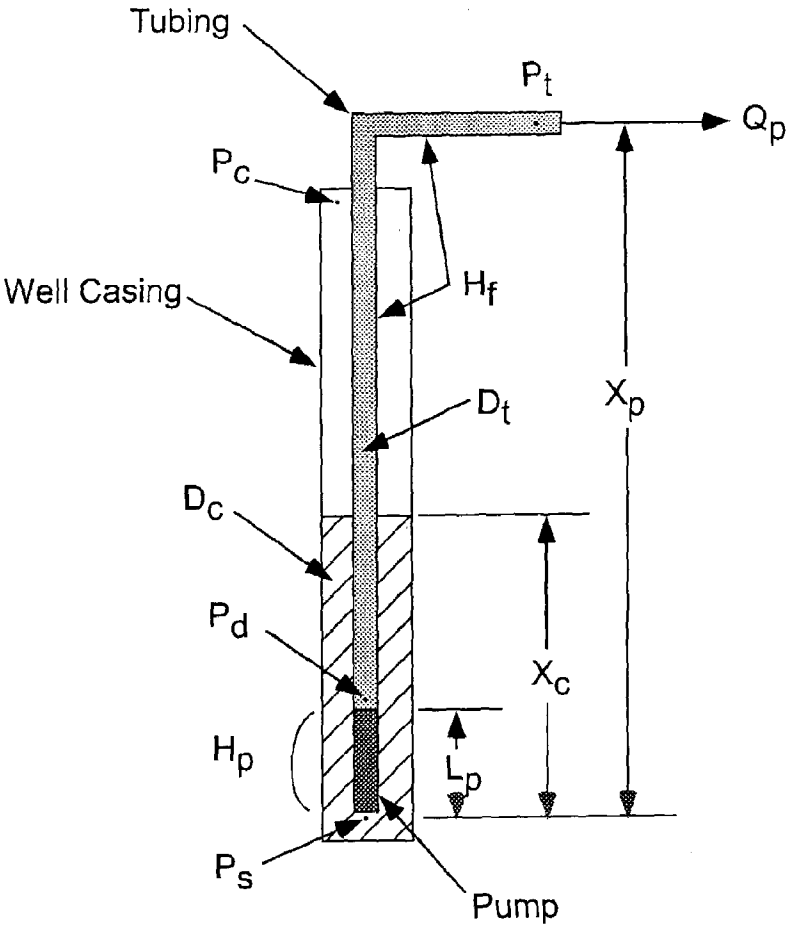
FIG. 14 is a diagram of a typical installation of a centrifugal pump, illustrating the relationship between the pumping system parameters.

Reference is now made to FIG. 7, which is a block diagram of an algorithm for the system model 80 of the fluid system 150. The system model 80 is used to calculate estimates of system parameters including pump suction pressure Pse, pump discharge pressure Pde, head flow loss Hfe and casing fluid level Xce. In one preferred embodiment, the calculations are carried out by the processing unit 54 (FIG. 2) under the control of software routines stored in the storage devices 55. FIG. 14 diagrammatically presents the actual reservoir system parameters used in FIG. 5 for the pump 32. Ps is the pump suction pressure, Pd is the pump discharge pressure, Hp is the pump head pressure, Hf is the flow head loss and Qp is the pump flow rate. Lp is the length of the pump, Lt (not shown) is the length of the tubing from the pump outlet to the tubing outlet, Xp is the pump depth and Xc is the fluid level within the casing 39 (FIG. 1). Pc is the pressure within the casing and Pt is the pressure within the tubing 38. Parameter Dt is the tubing fluid specific weight, parameter Dc is the casing fluid specific weight, and parameter Dp (not shown) is the specific weight of the fluid within the pump.

Briefly, with reference to FIG. 7, a value representing pump flow rate Qp (such as measured surface flow rate Qpm or estimated pump flow rate Qpe), pump head pressure estimate Hpe, and values of tubing pressure Pt and casing pressure Pc are combined with reservoir parameters of pump depth Xp and pump length Lp to determine pump suction pressure Pse and casing fluid level Xce.

More specifically, the processing unit 54 responds to the value representing pump flow rate Qp. This value representing pump flow rate Qp can be either the value of Qpe produced by the pump model 60, as shown in FIG. 3, or the value of Qpm as shown in FIG. 4 from a surface flow sensor 59 (FIG. 2). This pump flow rate value is used to calculate a tubing flow head loss estimate Hfe in block 81. The head loss equation for Hfe presented in block 81 can be derived empirically and fit to an appropriate equation or obtained from well known relationships for incompressible flow. One such relationship for flow head loss estimate Hfe is obtained from the Darcy-Weisbach equation:

$$Hfe=f[(L/d)(V^2/2G)] \quad (1)$$

where f is the friction factor, L is the length of the tubing, d is the inner diameter of the tubing, V is the average fluid velocity (Q/A, where Q is the fluid flow and A is the area of the tubing), and G is the gravitational constant. For laminar flow conditions (Re<2300), the friction factor f is equal to 64/Re, where Re is the Reynolds number. For turbulent flow conditions, the friction factor can be obtained using the Moody equation and a modified Colebrook equation, which will be known to one of ordinary skill in the art. For non-circular pipes, the hydraulic radius (diameter) equivalent may be used in place of the diameter in equation (1). Furthermore, in situ calibration may be employed to extract values for the friction factor f in equation (1) by system identification algorithms. Commercial programs that account for detailed hydraulic losses within the tubing are also available for calculation of fluid flow loss factors.

It should be noted that although fluid velocity V may change throughout the tubing length, the value for fluid velocity can be assumed to be constant over a given range.

The suction pressure Pse is calculated by adding the head loss Hfe calculated in block 81 with the pump depth Xp and subtracting the pump head pressure Hpe in summing block 82. The output of summing block 82 is scaled by the tubing fluid specific weight Dt in block 83 and added to the value representing tubing pressure Pt in summing block 84 to yield the suction pressure Pse.

The pump discharge pressure Pde is calculated by scaling the length of the pump Lp by the casing fluid specific weight Dc in block 87. The pump head pressure Hpe is then scaled by the pump fluid specific weight Dp in block 88 to yield the differential pressure across the pump, Ppe. Pump pressure Ppe is then added to the pump suction pressure Pse and the negative of the output of scaling block 87 in summing block 89 to calculate the pump discharge pressure Pde.

The casing fluid level Xce is calculated by subtracting casing pressure Pc from the suction pressure Pse, calculated in summing block 84, in summing block 85. The result of summing block 85 is scaled by the reciprocal of the casing fluid specific weight Dc in block 86 to yield the casing fluid level Xce.

The casing fluid specific weight Dc, pump fluid specific weight Dp, and tubing fluid specific weight Dt may differ due to different amounts and properties of dissolved gases in the fluid. At reduced pressures, dissolved gases may bubble out of the fluid and affect the fluid density. Numerous methods are available for calculation of average fluid density as a function of fluid and gas properties which are known in the art.

Fluid Level Feedforward Controller

Referring to FIG. 8, there is shown a process diagram of the fluid level feedforward controller 90. The fluid level feedforward controller 90 uses flow head loss Hfe, pump head pressure Hre at rated speed and other parameters to produce a motor speed feedforward command Umf to be summed with the motor speed feedback command Ufc in summing block 79 (FIG. 3 and FIG. 4) to produce the motor speed command Umc for the motor vector controller 130. This speed signal is based on predicting the pump speed required to maintain desired pressures, flows and levels in the pumping system. Use of this controller reduces the amount of fluid level error in the fluid level feedback controller 100 (FIG. 9), allowing conservative controller tuning and faster closed loop system response.

More specifically, in scaling block 91, the value of casing pressure Pc is scaled by the inverse of the casing fluid specific weight Dc to express the result in equivalent column height (head) of casing fluid. Similarly, in scaling block 92, the value of tubing pressure Pt is scaled by the inverse of the tubing fluid specific weight Dt to express the result in equivalent column height (head) of tubing fluid. In summing block 93, the negative of the output of block 91 is added to the output of block 92, the pipe head flow loss Hfe, the depth of the pump Xp, and the negative of the commanded casing fluid level Xcc to obtain pump head pressure command Hpc. The flow head loss Hfe is the reduction in pressure due to fluid friction as calculated in block 81 (FIG. 7). The commanded pump head Hpc is the pressure that the pump must produce as a result of the inputs to summing block 93. The values of casing pressure Pc and tubing pressure Pt can be measured in real time using above ground sensors in systems where they are variable or fixed for systems where they are relatively constant. The values of pump depth Xp and commanded casing fluid level command Xcc are known.

More specifically, in block 94, the pump speed required to produce the pressure required by the head pressure command Hpc is calculated by multiplying the rated speed Ur by the square root of the ratio of the head pressure command Hpc to the head pressure at rated speed Hre to yield the motor speed feedforward command Umf. The value of head pressure at rated speed Hre is calculated by block 65 of FIG. 5 or block 265 of FIG. 6 depending on the specific embodiment.

Fluid Level Feedback Controller

Figure 9:
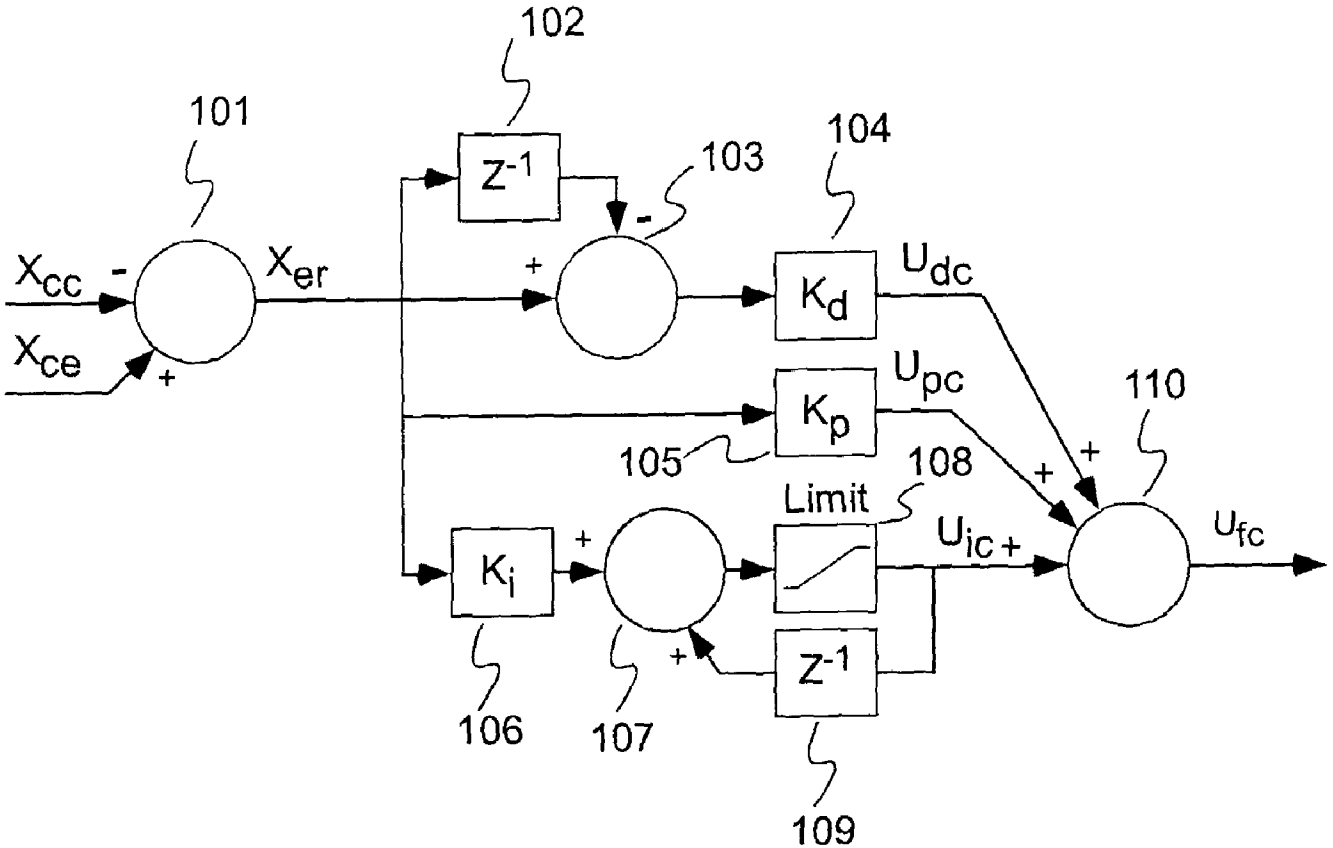
FIG. 9 is a block diagram of an algorithm for a fluid level feedback controller of the centrifugal pump control system of FIGS. 3 and 4.

Reference is now made to FIG. 9, which is a block diagram of a fluid level feedback controller 100 for the motor vector controller 130. The fluid level feedback controller 100 includes a PID (proportional, integral, derivative) function that responds to errors between casing fluid level command Xcc and casing fluid level Xce to adjust the speed command for the pump 32. Operation of the fluid level feedforward controller 90 provides a command based on the projected operation of the system. This assures that the errors to which the fluid level feedback controller 100 must respond will only be the result of disturbances to the system.

The inputs to the fluid level feedback controller 100 include casing fluid level command Xcc and a casing fluid level value Xce. The fluid level command Xcc is a known value and is subtracted from the casing fluid level value Xce in block 101 to produce the error signal Xer for the fluid level feedback controller 100.

The algorithm of the fluid level feedback controller 100 uses Z-transformations to obtain values for the discrete PID controller. The term $Z^{-1}$ (blocks 102 and 109) means that the value from the previous iteration is used during the current iteration.

More specifically, in summing block 101, an error signal Xer is produced by subtracting Xcc from Xce. The speed command derivative error term Udc is calculated by subtracting, in summing block 103, the current Xer value obtained in block 101 from the previous Xer term obtained from block 102 and multiplying by the derivative gain Kd in block 104. The speed command proportional error term Upc is calculated by multiplying the proportional gain Kp in block 105 by the current Xer value obtained in block 101. The speed command integral error term Uic is calculated by multiplying the integral gain Ki in block 106 by the current Xer value obtained in block 101 and summing this value in block 107 with the previous value of Uic obtained from block 109. The output of summing block 107 is passed through an output limiter, block 108, to produce the current integral error term Uic. The three error terms, Udc, Upc and Uic, are combined in summing block 110 to produce the speed command Ufc to be summed with the motor speed feedforward command Umf in summing block 79 (FIG. 3 and FIG. 4) for the motor vector controller 130.

Vector Controller

Figure 10:
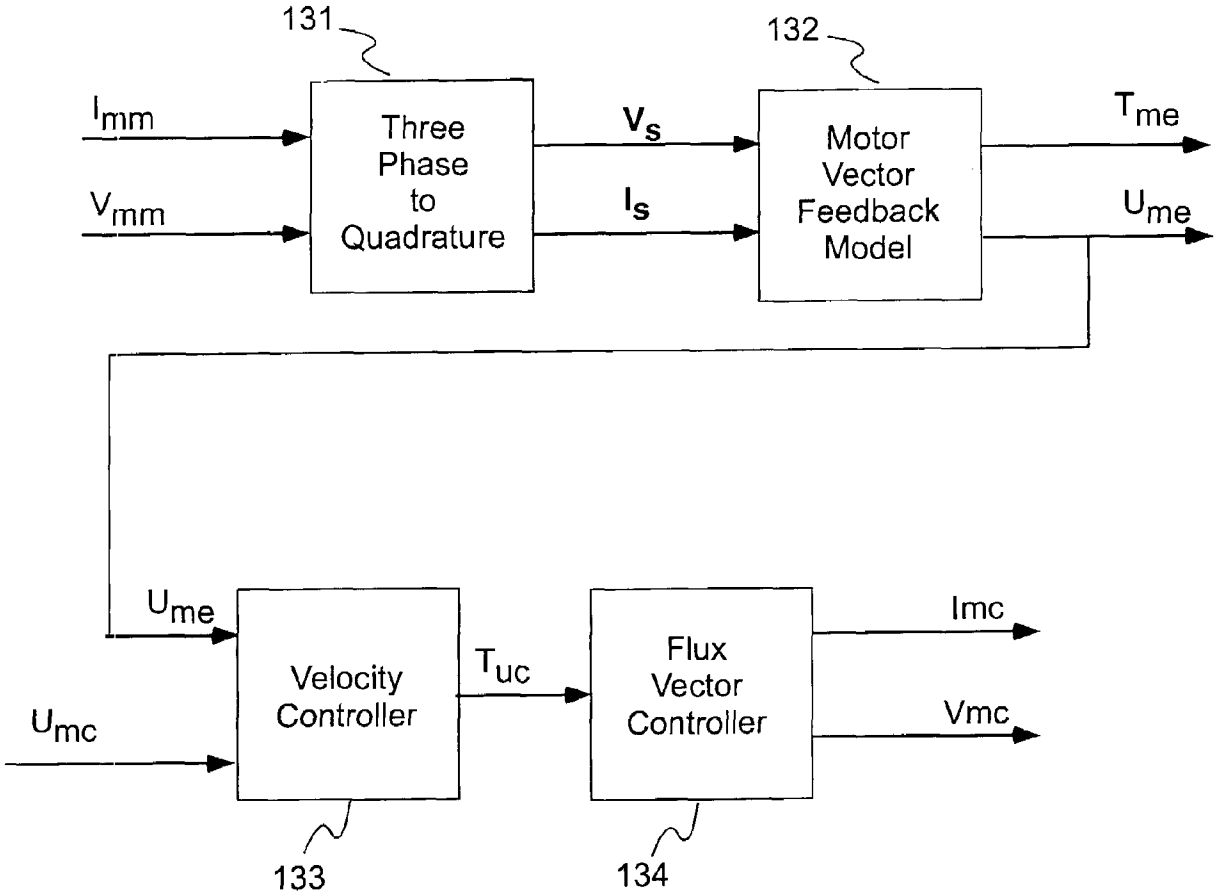
FIG. 10 is a simplified block diagram of an algorithm for a vector controller of the centrifugal pump control system of FIGS. 3 and 4.

Reference is now made to FIG. 10, which is a simplified block diagram of the motor vector controller 130. The motor vector controller 130 contains functions for calculating the velocity error and the torque necessary to correct it, convert torque commands to motor voltage commands and current commands and calculate motor torque and speed estimates from measured values of motor voltages and motor currents.

In one embodiment, the stator flux is calculated from motor voltages and currents and the electromagnetic torque is directly estimated from the stator flux and stator current. More specifically, in block 131, three-phase motor voltage measurements Vmm and current measurements Imm are converted to dq (direct/quadrature) frame signals using three to two phase conversion for ease of computation in a manner known in the art. Signals in the dq frame can be represented as individual signals or as vectors for convenience. The motor vector feedback model 132 responds to motor stator voltage vector Vs and motor stator current vector Is to calculate a measure of electrical torque Tme produced by the motor. In one embodiment, the operations carried out by motor vector feedback model 132 for calculating the electrical torque estimate are as follows. The stator flux vector Fs is obtained from the motor stator voltage Vs and motor stator current Is vectors according to equation (2):

$$Fs=(Vs-Is.Rs)/s \tag{2}$$

$$Fds=(Vds-Is.Rs)/s \tag{2A}$$

$$Fqs=(Vqs-+Iqs.Rs)/s \tag{2B}$$

where Rs is the stator resistance and s (in the denominator) is the Laplace operator for differentiation. Equations (2A) and (2B) show typical examples of the relationship between the vector notation for flux Fs, voltage Vs, and current Is and actual d axis and q axis signals.

In one embodiment, the electrical torque Tme is estimated directly from the stator flux vector Fs obtained from equation (2) and the measured stator current vector Is according to equation (3) or its equivalent (3A):

$$Tme=Ku.(3/2).P.Fs\times Is \quad (3)$$

$$Tme=Ku.(3/2).P.(Fds.Iqs-Fqs.Ids) \quad (3A)$$

where P is the number of motor pole pairs and Ku is a unit scale factor to get from MKS units to desired units.

In one embodiment, rotor velocity Ume is obtained from estimates of electrical frequency Ue and slip frequency Us. The motor vector feedback model 132 also performs this calculation using the stator voltage Vs and stator current Is vectors. In one embodiment, the operations carried out by the motor vector feedback model 132 for calculating the motor velocity Ume are as follows. A rotor flux vector Fr is obtained from the measured stator voltage Vs and stator current Is vectors along with motor stator resistance Rs, stator inductance Ls, magnetizing inductance Lm, leakage inductance SigmaLs, and rotor inductance Lr according to equations (4) and (5); separate d axis and q axis rotor flux calculations are shown in equations (5A) and (5B) respectively:

$$\text{Sigma}Ls=Ls-Lm^2/Lr \quad (4)$$

then, $$Fr=(Lr/Lm).[Fs-Is.\text{Sigma}Ls] \quad (5)$$

$$Fdr=(Lr/Lm).(Fds-\text{Sigma}Ls.Ids) \quad (5A)$$

$$Fqr=(Lr/Lm).(Fqs-\text{Sigma}Ls.Iqs) \quad (5B)$$

The slip frequency Us can be derived from the rotor flux vector Fr, the stator current vector Is, magnetizing inductance Lm, rotor inductance Lr, and rotor resistance Rr according to equation (6):

$$Us = Rr\cdot(Lm/Lr)\cdot\frac{[Fdr\cdot Iqs - Fqr\cdot Ids]}{Fdr^2 + Fqr^2} \quad (6)$$

The instantaneous excitation or electrical frequency Ue can be derived from stator flux according to equation (7):

$$Ue = \frac{Fds\cdot sFqs - Fqs\cdot sFds}{Fds^2 + Fqs^2} \quad (7)$$

The rotor velocity or motor velocity Ume can be derived from the number of motor pole pairs P the slip frequency Us and the electrical frequency Ue according to equation (8):

$$Ume=(Ue-Us)(60)/P \quad (8)$$

In cases where long cable lengths or step up transformers are used, the impedances of the additional components can be added to the model of motor impedances in a method that is known.

The velocity controller 133 uses a PI controller (proportional, integral), PID controller (proportional, integral, derivative) or the like to compare the motor speed Ume with the motor speed command Umc and produce a speed error torque command Tuc calculated to eliminate the speed error. The speed error torque command Tuc is then converted to motor current commands Imc and voltage commands Vmc in flux vector controller 134 using a method which is known.

Figure 15:
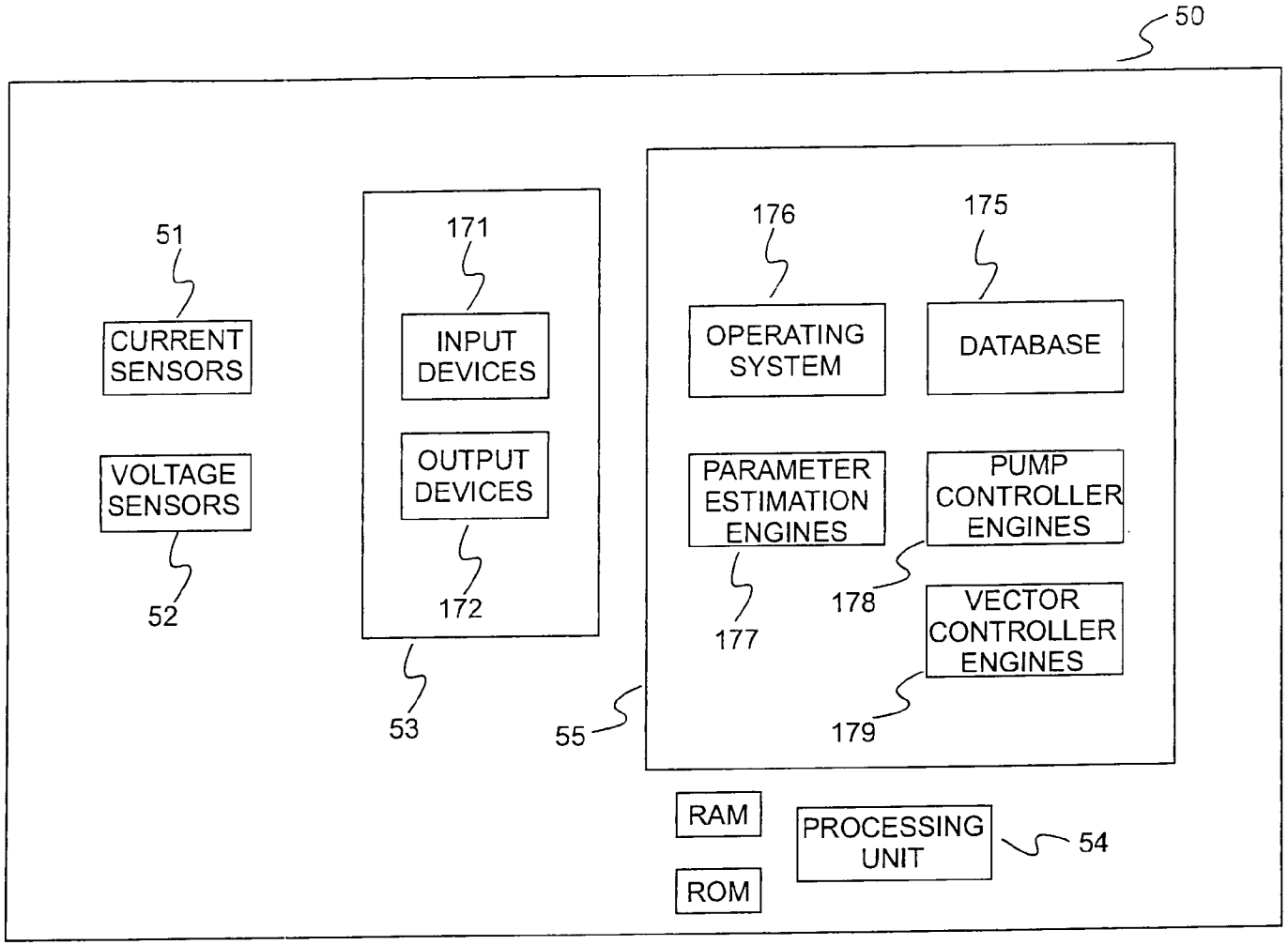
FIG. 15 is a block diagram of the controller of the pump control system of FIGS. 3 and 4.

Referring to FIG. 15, in one preferred embodiment, the pump control system provided by the present invention is software based and is capable of being executed in a controller 50 shown in block diagram form in FIG. 13. In one embodiment, the controller 50 includes current sensors 51, voltage sensors 52, input devices 171, such as analog to digital converters, output devices 172, and a processing unit 54 having associated random access memory (RAM) and read-only memory (ROM). In one embodiment, the storage devices 55 include a database 175 and software programs and files which are used in carrying out simulations of circuits and/or systems in accordance with the invention. The programs and files of the controller 50 include an operating system 176, the parameter estimation engines 177 that includes the algorithms for the pump model 60 (FIG. 5) or pump model 260 (FIG. 6) and the pump system model 80 (FIG. 7), pump controller engines 178 that include the algorithms for fluid level feedforward controller 90 (FIG. 8) and the fluid level feedback controller 100 (FIG. 9), and vector controller engines 179 for the motor vector controller 130 for converting motor current and voltage measurements to torque and speed estimates and converting speed and torque feedforward commands to motor current and voltage commands, for example. The programs and files of the computer system can also include or provide storage for data. The processing unit 54 is connected through suitable input/output interfaces and internal peripheral interfaces (not shown) to the input devices, the output devices, the storage devices, etc., as is known.

Optimized Gas Production

The production of methane gas from coal seams can be optimized using the estimated parameters obtained by the pump controller 50 (FIG. 3 or FIG. 4) in accordance with the invention. For methane gas production, it is desirable to maintain the casing fluid level at an optimum level. A range for casing fluid level command Xcc is selected to define an optimal casing fluid level for extracting methane gas. This range is commonly referred to as a sweet zone.

In one embodiment of the present invention, the selection of the sweet zone is determined by the controller 50 (FIG. 3 or FIG. 4) that searches to find the optimum casing fluid level command Xcc. Since the sweet zone can change as conditions in the well change over time, it can be advantageous to program the controller 50 to perform these searches at periodic intervals or when specific conditions, such as a decrease in efficiency, are detected. In determining the sweet zone, the centrifugal pump intake pressure Ps or casing fluid level Xc is controlled. The centrifugal pump 32 is controlled by the fluid level feedforward controller 90 and the fluid level feedback controller 100 to cause the casing fluid level Xc to be adjusted until maximum gas production is obtained. The casing fluid level command Xcc is set to a predetermined start value. The methane gas flow through outlet 42 at the surface is measured. The casing fluid level command is then repeatedly incremented to progressively lower values. The methane gas production is measured at each new level to determine the value of casing fluid level Xc at which maximum gas production is obtained. The point of optimum performance is called the sweet spot. The sweet zone is the range of casing fluid level above and below the sweet spot within which the gas production decrease is acceptable. However, the selection of the sweet zone can be done manually by taking readings.

Improved Pump Energy Efficiency and Operating Range

Figure 16:
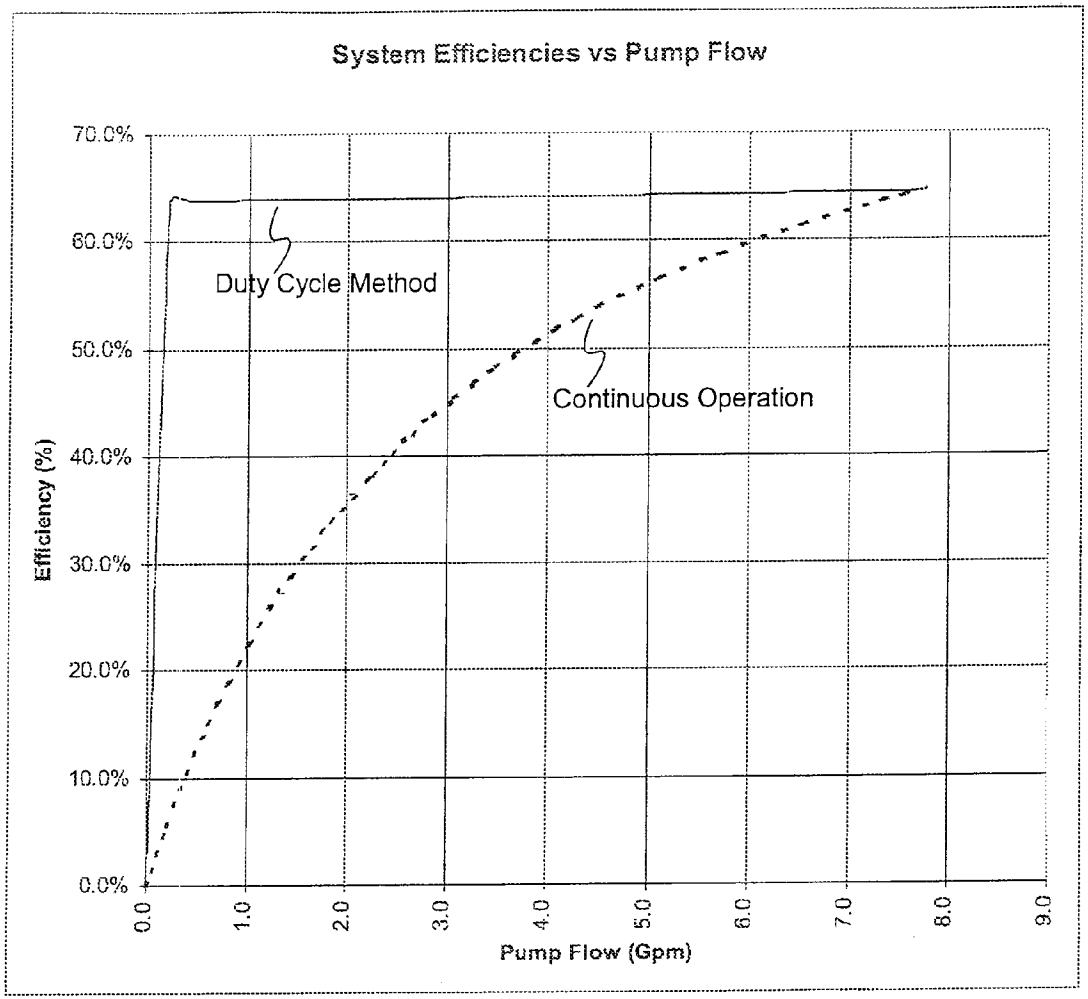
FIG. 16 is a set of two curves comparing the efficiency of a pumping system using duty cycle control to the efficiency of a pumping system using continuous rotary speed.

One method to optimize the pump control when operated at low flow and/or efficiency, is to operate using a duty cycle mode to produce the required average flow rate while still operating the centrifugal pump at its most efficient and optimal flow rate point Qo. In this duty cycle mode, the volume of fluid to be removed from the casing can be determined using the fluid inflow rate Qi when the casing fluid level Xc is near the desired level. A fluid level tolerance band is defined around the desired fluid level, within which the fluid level is allowed to vary. The volume Vb of the fluid level tolerance band is calculated from the projected area between the tubing, casing and pump body and the prescribed length of the tolerance band. This volume is used with the fluid inflow rate Qi to determine the pump off time period Toff. When the centrifugal pump is on, the value for casing fluid level Xc is calculated and the fluid level in the casing is reduced to the lower level of the fluid level tolerance band, when the pump is again turned off. The fluid inflow rate Qi is calculated by dividing the fluid level tolerance band volume Vb by the on time period Ton used to empty the band, then subtracting the result from the optimal pump flow rate Qo used to empty the band. The on-off duty cycle varies automatically to adjust for changing well inflow characteristics. This variable duty cycle continues with the centrifugal pump operating at its maximum efficiency over a range of average pump flow rates varying from almost zero to the flow associated with full time operation at the most efficient speed. Use of the duty cycle mode also increases the range of controllable pump average flow by using the ratio of on time, Ton, multiplied by optimal flow rate, Qo, divided by total cycle time (Ton+Toff) rather than the centrifugal pump speed to adjust average flow. This also avoids the problem of erratic flow associated with operating the pump at very low speeds. This duty cycle method can produce significant energy savings at reduced average flow rates as shown in FIG. 16. As can be seen in FIG. 16, the efficiency of the example pump using continuous operation decreases rapidly below about 7.5 gallons per minute (GPM), while the efficiency of the same pump operated using the duty cycle method remains at near optimum efficiency over the full range of average flow.

Pump system efficiency is determined by the ratio of the fluid power output to the mechanical or electrical power input. When operated to maximize efficiency, the controller turns the centrifugal pump off when the centrifugal pump starts operating in an inefficient range. In addition, the centrifugal pump is turned off if a pump off condition casing level at the pump intake is detected by a loss of measured flow.

For systems with widely varying flow demands, multiple centrifugal pumps, each driven by a separate motor, may be connected in parallel and staged (added or shed) to supply the required capacity and to maximize overall efficiency. The decision for staging multiple centrifugal pumps is generally based on the maximum operating efficiency or capacity of the centrifugal pump or combination of centrifugal pumps. As such, when a system of centrifugal pumps is operating beyond its maximum efficiency point or capacity and another centrifugal pump is available, a centrifugal pump is added when the efficiency of the new combination of centrifugal pumps exceeds the current operating efficiency. Conversely, when multiple centrifugal pumps are operating in parallel and the flow is below the combined maximum efficiency point, a centrifugal pump is shed when the resulting combination of centrifugal pumps have a better efficiency. These cross-over points can be calculated directly from the efficiency data for each centrifugal pump in the system, whether the additional centrifugal pumps are variable speed or fixed speed.

Pump and Pump System Protection

One method of protecting the centrifugal pump and system components is to use sensors to measure the performance of the system above ground and compare this measurement to a calculated performance value. If the two values differ by a threshold amount, a fault sequence is initiated which may include such steps as activating an audio or visual alarm for the operator, activating an alarm signal to a separate supervisory controller or turning off the centrifugal pump. In one embodiment, a sensor is used to measure the flow in the tubing at the surface Qpm and compare it with the calculated value Qpe. If the actual flow Qpm is too low relative to the calculated flow Qpe, this could be an indication of a fault such as a tubing leak, where not all of the flow through the centrifugal pump is getting to the measurement point.

Another method of protecting the pump is to prevent excessive mechanical power input. In one embodiment, the mechanical power input to the pump is calculated by multiplying the speed Ume by the torque Tme. The result is compared to the mechanical input power limit Ple calculated by the pump model (FIG. 5 or FIG. 6). If the limit Ple is exceeded, the torque and speed are reduced to protect the pump.

Although exemplary embodiments of the present invention have been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A method of controlling a centrifugal pump for transferring fluid within a fluid system, the method comprising the steps of:

determining a value of speed input to the centrifugal pump;

determining a value of pump flow rate;

using the value of speed input and the value of pump flow rate to calculate one or more values representing the performance of the centrifugal pump;

using the centrifugal pump performance values to produce one or more command signals, including the steps of selecting a centrifugal pump performance parameter to control, determining a setpoint for the selected centrifugal pump performance parameter, calculating a control signal using the setpoint value of the selected centrifugal pump performance parameter, and calculating the one or more command signals from the control signal; and using the one or more command signals to control the speed of the centrifugal pump, wherein the selected centrifugal pump performance parameter is the pump flow rate and the step of using the one or more command signals to control the speed of the centrifugal pump includes repetitively switching the speed of the centrifugal pump between a set pump speed for a portion of a cycle period and zero speed for the remainder of the cycle period to achieve an average pump flow rate equal to the setpoint value of the pump flow rate.

2. A method of controlling a centrifugal pump for transferring fluid within a fluid system, wherein the centrifugal pump is coupled to an electric motor, the method comprising the steps of:

determining a value of speed input to the centrifugal pump, including the steps of measuring values of electrical voltages applied to the motor and currents drawn by the motor, and using the measured values of electrical voltages applied to the motor and currents drawn by the motor to calculate a value for the motor speed;

determining a value of pump flow rate;

using the value of speed input and the value of pump flow rate to calculate one or more values representing the performance of the centrifugal pump;

using the centrifugal pump performance values to produce one or more command signals, including the steps of selecting a centrifugal pump performance parameter to control, determining a setpoint for the selected centrifugal pump performance parameter, calculating a control signal using the setpoint value of the selected centrifugal pump performance parameter, and calculating the one or more command signals from the control signal; and using the one or more command signals to control the speed of the centrifugal pump, wherein the selected centrifugal pump performance parameter is the pump flow rate and the step of using the one or more command signals to control the speed of the centrifugal pump includes repetitively switching the speed of the centrifugal pump between a set pump speed for a portion of a cycle period and zero speed for the remainder of the cycle period to achieve an average pump flow rate equal to the setpoint value of the pump flow rate.

3. A method of controlling a centrifugal pump for transferring fluid within a fluid system, the method comprising the steps of:

determining a value of speed input to the centrifugal pump;

determining a value of pump flow rate;

using the value of speed input and the value of pump flow rate to calculate one or more values representing the performance of the centrifugal pump;

using the centrifugal pump performance values to produce one or more command signals; and using the command signals to control the speed of the centrifugal pump, wherein the values representing the performance of the pump comprise values representing pump mechanical input power limit and pump mechanical input power, and the step of using the one or more command signals to control the speed of the centrifugal pump includes the steps of:

comparing the pump mechanical input power limit and pump mechanical input power, and reducing the speed of the centrifugal pump if the value of pump mechanical input power is greater than the pump mechanical input power limit.

4. The method of claim 3, wherein the step of using centrifugal pump performance values to produce command signals comprises the steps of:

selecting a centrifugal pump performance parameter to control;

determining a setpoint for the selected centrifugal pump performance parameter;

calculating a control signal using the setpoint value of the selected centrifugal pump performance parameter; and calculating the command signals from the control signal.

5. The method of claim 4, wherein the selected centrifugal pump performance parameter is the pump head pressure.

6. The method of claim 3, wherein the centrifugal pump is coupled to an electric motor and the step of determining the speed input to the centrifugal pump comprises the steps of:

measuring values of electrical voltages applied to the motor and currents drawn by the motor; and using the measured values of electrical voltages applied to the motor and currents drawn by the motor to calculate a value for the motor speed.

7. The method of claim 6, wherein the step of using centrifugal pump performance values to produce the one or more command signals comprises the steps of:

selecting a centrifugal pump performance parameter to control;

determining a setpoint for the selected centrifugal pump performance parameter;

calculating a control signal using the setpoint value of the selected centrifugal pump performance parameter; and calculating the one or more command signals from the control signal.

8. The method of claim 7, wherein the selected centrifugal pump performance parameter is the pump head pressure.

9. A method of controlling a centrifugal pump for transferring fluid within a fluid system, the method comprising the steps of:

determining a value of speed input to the centrifugal pump;

determining a value of torque input to the centrifugal pump;

using the value of speed input and the value of torque input to calculate one or more values representing the performance of the centrifugal pump;

using the centrifugal pump performance values to produce one or more command signals, including the steps of selecting a centrifugal pump performance parameter to control, determining a setpoint for the selected centrifugal pump performance parameter, calculating a control signal using the setpoint value of the selected centrifugal pump performance parameter; and calculating the one or more command signals from the control signal, and using the one or more command signals to control the speed of the centrifugal pump, wherein the selected centrifugal pump performance parameter is the pump flow rate and wherein the step of using the one or more command signals to control the speed the centrifugal pump includes repetitively switching the speed of the centrifugal pump between a set pump speed for a portion of a cycle period and zero speed for the remainder of the cycle period to achieve an average pump flow rate equal to the setpoint value of the pump flow rate.

10. A method of controlling a centrifugal pump for transferring fluid within a fluid system, wherein the centrifugal pump is coupled to an electric motor, the method comprising the steps of:

determining a value of speed input to the centrifugal pump and determining a value of torque input to the centrifugal pump, including measuring values of electrical voltages applied to the motor and currents drawn by the motor, and using the measured values of electrical voltages applied to the motor and currents drawn by the motor to calculate a value for at least one of the parameters selected from the group consisting of motor torque and the motor speed;

using the value of speed input and the value of torque input to calculate one or more values representing the performance of the centrifugal pump;

using the centrifugal pump performance values to produce one or more command signals, including the steps of selecting a centrifugal pump performance parameter to control, determining a setpoint for the selected centrifugal pump performance parameter, calculating a control signal using the setpoint value of the selected centrifugal pump performance parameter, and calculating the one or more command signals from the control signal; and using the one or more command signals to control the speed of the centrifugal pump, wherein the selected centrifugal pump performance parameter is the pump flow rate; and wherein the step of using the one or more command signals to control the speed of the centrifugal pump includes repetitively switching the speed of the centrifugal pump between a set pump speed for a portion of a cycle period and zero speed for the remainder of the cycle period to achieve an average pump flow rate equal to the setpoint value of the pump flow rate.

11. A method of controlling a centrifugal pump for transferring fluid within a fluid system, the method comprising the steps of:

determining a value of speed input to the centrifugal pump;

determining a value of torque input to the centrifugal pump;

using the value of speed input and the value of torque input to calculate one or more values representing the performance of the centrifugal pump;

using the centrifugal pump performance values to produce one or more command signals; and using the one or more command signals to control the speed of the centrifugal pump, wherein the values representing the performance of the pump comprise values representing pump mechanical input power limit and pump mechanical input power, and the step of using the one or more command signals to control the speed of the centrifugal pump includes the steps of:

comparing the pump mechanical input power limit and pump mechanical input power; and reducing the speed of the centrifugal pump if the value of pump mechanical input power is greater than the pump mechanical input power limit.

12. The method of claim 11, wherein the step of using centrifugal pump performance values to produce the one or more command signals comprises the steps of:

selecting a centrifugal pump performance parameter to control;

determining a setpoint for the selected centrifugal pump performance parameter;

calculating a control signal using the setpoint value of the selected centrifugal pump performance parameter; and calculating the one or more command signals from the control signal.

13. The method of claim 12, wherein the selected centrifugal pump performance parameter is the pump flow rate.

14. The method of claim 12, wherein the selected centrifugal pump performance parameter is the pump head pressure.

15. The method of claim 11, wherein the centrifugal pump is coupled to an electric motor and the step of determining the speed input and the torque input to the centrifugal pump comprises the steps of:

measuring values of electrical voltages applied to the motor and currents drawn by the motor; and using the measured values of electrical voltages applied to the motor and currents drawn by the motor to calculate a value for at least one of the parameters selected from the group consisting of motor torque and the motor speed.

16. The method of claim 15, wherein the step of using centrifugal pump performance values to produce the one or more command signals comprises the steps of:

selecting a centrifugal pump performance parameter to control;

determining a setpoint for the selected centrifugal pump performance parameter;

calculating a control signal using the setpoint value of the selected centrifugal pump performance parameter; and calculating the one or more command signals from the control signal.

17. The method of claim 16, wherein the selected centrifugal pump performance parameter is the pump flow rate.

18. The method of claim 16, wherein the selected centrifugal pump performance parameter is the pump head pressure.

19. A method of controlling the performance of a fluid system wherein a centrifugal pump is used for transferring fluid within said fluid system, the method comprising the steps of:

determining values of torque and speed inputs to the centrifugal pump;

using the values of torque and speed inputs to calculate one or more values representing the performance of the centrifugal pump;

using the values representing the performance of the centrifugal pump to calculate values representing the performance of the fluid system;

using the system performance values to produce one or more command signals, including deriving a setpoint value for a fluid system performance parameter from a fluid level command, and using the setpoint value in calculating the one or more command signals; and using the one or more command signals to control the speed of the centrifugal pump.

20. The method of claim 19, wherein the step of using fluid system performance values to produce the one or more command signals comprises the further steps of:

selecting a fluid system performance parameter to control;

the setpoint value being derived for the selected fluid system performance parameter;

calculating a control signal using the setpoint value of the selected fluid system performance parameter; and calculating the one or more command signals from the control signal.

21. The method of claim 20, wherein the selected fluid system performance parameter to control is the pump suction pressure.

22. The method of claim 19 wherein the centrifugal pump is coupled to an electric motor and the step of determining the torque and speed inputs to the centrifugal pump comprises the steps of:

measuring values of electrical voltages applied to the motor and currents drawn by the motor; and using the measured values of electrical voltages applied to the motor and currents drawn by the motor to calculate values for at least one of the parameters selected from the group consisting of motor torque and motor speed.

23. The method of claim 22, wherein the step of using fluid system performance values to produce one or more command signals comprises the further steps of:

selecting a fluid system performance parameter to control, the setpoint value being derived for the selected fluid system performance parameter;

calculating a control signal using the selected fluid system performance parameter; and calculating the one or more command signals from the control signal.

24. The method of claim 23, wherein the selected fluid system performance parameter to control is the pump suction pressure.

25. A method of controlling the performance of a fluid system wherein a centrifugal pump is used for transferring fluid within said fluid system, the method comprising the steps of:

determining values of torque and speed inputs to the centrifugal pump;

using the values of torque and speed inputs to calculate one or more values representing the performance of the centrifugal pump;

using the values representing the performance of the centrifugal pump to calculate values representing the performance of the fluid system;

using the system performance values to produce one or more command signals, including the steps of selecting a fluid system performance parameter to control, determining a setpoint for the selected fluid system performance parameter, calculating a control signal using the setpoint value of the selected fluid system performance parameter, and calculating the one or more command signals from the control signal, and using the command signals to control the speed of the centrifugal pump, wherein the selected fluid system performance parameter to control is the pump suction pressure and further comprising the step of deriving the setpoint value for pump suction pressure from a fluid level command.

26. The method of claim 25, further comprising the step of determining the fluid level command, said step of determining the fluid level command comprising the steps of:

defining a fluid system performance characteristic to optimize;

varying the fluid level incrementally through a range of values;

determining a value representing the fluid system performance characteristic for each value of fluid level;

determining for which value of fluid level the value representing the fluid system performance characteristic is optimized; and setting the fluid level command at the level which produces the optimized value.

27. The method of claim 26, wherein the step of determining the fluid level command is automatically repeated at predetermined times.

28. The method of claim 26, further comprising the step of periodically determining the pump efficiency and repeating the step of determining the fluid level command when a decrease in pump efficiency relative to prior determinations of pump efficiency is detected.

29. The method of claim 26, wherein the fluid system is a gas well, further comprising the step of periodically determining the gas production and repeating the step of determining the fluid level command when a decrease in gas production relative to prior determinations of gas production is detected.

30. A method of controlling the performance of a fluid system wherein a centrifugal pump is used for transferring fluid within said fluid system, the method comprising the steps of:

determining values of torque and speed inputs to the centrifugal pump;

using the values of torque and speed inputs to calculate one or more values representing the performance of the centrifugal pump;

using the values representing the performance of the centrifugal pump to calculate values representing the performance of the fluid system;

using the system performance values to produce one or more command signals, including the steps of selecting a fluid system performance parameter to control; determining a setpoint for the selected fluid system performance parameter; calculating a control signal using the setpoint value of the selected fluid system performance parameter; and calculating the one or more command signals from the control signal; and using the command signals to control the speed of the centrifugal pump, wherein the selected fluid system performance parameter to control is the pump suction pressure and wherein the step of using the one or more command signals to control the speed of the centrifugal pump includes repetitively performing the steps of operating the centrifugal pump at a set speed until the pump suction pressure decreases to a value less than or equal to a pump suction pressure lower limit, said pump suction pressure lower limit equal to the pump suction pressure setpoint minus a tolerances, and operating the centrifugal pump at zero speed until the pump suction pressure increases to a value greater than or equal to a pump suction pressure upper limit, said pump suction pressure upper limit equal to the pump suction pressure setpoint plus a tolerance.

31. A method of controlling the performance of a fluid system wherein a centrifugal pump is used for transferring fluid within said fluid system, wherein the centrifugal pump is coupled to an electric motor, the method comprising the steps of:

determining values of torque and speed inputs to the centrifugal pump, including the steps of measuring values of electrical voltages applied to the motor and currents drawn by the motor, and using the measured values of electrical voltages applied to the motor and currents drawn by the motor to calculate values for at least one of the parameters selected from the group consisting of motor torque and motor speed;

using the values of torque and speed inputs to calculate one or more values representing the performance of the centrifugal pump;

using the values representing the performance of the centrifugal pump to calculate values representing the performance of the fluid system;

using the system performance values to produce one or more command signals, including the steps of selecting a fluid system performance parameter to control, including the steps of determining a setpoint for the selected fluid system performance parameter, calculating a control signal using the selected fluid system performance parameter, and calculating the one or more command signals from the control signal; and using the one or more command signals to control the speed of the centrifugal pump;

wherein the selected fluid system performance parameter to control is the pump suction pressure, and further comprising the step of deriving the setpoint value for pump suction pressure from a fluid level command.

32. The method of claim 31, further comprising the step of determining the fluid level command, said step of determining the fluid level command comprising the steps of:

defining a fluid system performance characteristic to optimize;

varying the fluid level incrementally through a range of values;

determining a value representing the fluid system performance characteristic for each value of fluid level;

determining for which value of fluid level the value representing the fluid system performance characteristic is optimized; and setting the fluid level command at the level which produces the optimized value.

33. The method of claim 32, wherein the step of determining the fluid level command is automatically repeated at predetermined times.

34. The method of claim 32, further comprising the step of periodically determining the pump efficiency and repeating the step of determining the fluid level command when a decrease in pump efficiency relative to prior determinations of pump efficiency is detected.

35. The method of claim 32, wherein the system is a gas well, further comprising the step of periodically determining the gas production and repeating the step of determining the fluid level command when a decrease in gas production is detected.

36. A method of controlling the performance of a fluid system wherein a centrifugal pump is used for transferring fluid within said fluid system and wherein the centrifugal pump is coupled to an electric motor, the method comprising the steps of:

determining values of torque and speed inputs to the centrifugal pump, including the steps of measuring values of electrical voltages applied to the motor and currents drawn by the motor, and using the measured values of electrical voltages applied to the motor and currents drawn by the motor to calculate values for at least one of the parameters selected from the group consisting of motor torque and motor speed;

using the values of torque and speed inputs to calculate one or more values representing the performance of the centrifugal pump;

using the values representing the performance of the centrifugal pump to calculate values representing the performance of the fluid system;

using the system performance values to produce one or more command signals, including the steps of selecting a fluid system performance parameter to control, including the steps of determining a setpoint for the selected fluid system performance parameter, calculating a control signal using the selected fluid system performance parameter, and calculating the one or more command signals from the control signal; and using the one or more command signals to control the speed of the centrifugal pump, wherein the selected fluid system performance parameter to control is the pump suction pressure, and wherein the step of using the one or more command signals to control the speed of the centrifugal pump includes repetitively performing the steps of operating the centrifugal pump at a set speed until the pump suction pressure decreases to a value less than or equal to a pump suction pressure lower limit, said pump suction pressure lower limit calculated as the pump suction pressure setpoint minus a tolerance; and operating the centrifugal pump at zero speed until the pump suction pressure increases to a value greater than or equal to a pump suction pressure upper limit, said pump suction pressure upper limit calculated as the pump suction pressure setpoint plus a tolerance.

37. A method of controlling the performance of a fluid system wherein a centrifugal pump is used for transferring fluid within said fluid system, the method comprising the steps of:

determining a value of speed input to the centrifugal pump;

determining a value of pump flow rate;

using the value of speed input and the value of pump flow rate to calculate one or more values representing the performance of the centrifugal pump;

using the values representing the performance of the centrifugal pump to calculate values representing the performance of the fluid system;

using the system performance values to produce one or more command signals, including deriving a setpoint value for a fluid system performance parameter from a fluid level command, and using the setpoint value in calculating the one or more command signals; and using the one or more command signals to control the speed of the centrifugal pump.

38. The method of claim 37, wherein the step of using fluid system performance values to produce command signals comprises the further steps of:

selecting a fluid system performance parameter to control;

the setpoint value being derived for the selected fluid system performance parameters;

calculating a control signal using the setpoint value of the selected fluid system performance parameter; and calculating the one or more command signals from the control signal.

39. The method of claim 38, wherein the selected fluid system performance parameter to control is the pump suction pressure.

40. The method of claim 37 wherein the centrifugal pump is coupled to an electric motor and the step of determining the speed input to the centrifugal pump comprises the steps of:

measuring values of electrical voltages applied to the motor and currents drawn by the motor; and using the measured values of electrical voltages applied to the motor and currents drawn by the motor to calculate a value for motor speed.

41. The method of claim 40, wherein the step of using fluid system performance values to produce command signals comprises the steps of:

selecting a fluid system performance parameter to control;

the setpoint being derived for the selected fluid system performance parameter;

calculating a control signal using the selected fluid system performance parameter; and calculating the one or more command signals from the control signal.

42. The method of claim 41, wherein the selected fluid system performance parameter to control is the pump suction pressure.

43. A method of controlling the performance of a fluid system, wherein a centrifugal pump is used for transferring fluid within said fluid system, the method comprising the steps of:

determining a value of speed input to the centrifugal pump;

determining a value of pump flow rate;

using the value of speed input and the value of pump flow rate to calculate one or more values representing the performance of the centrifugal pump;

using the values representing the performance of the centrifugal pump to calculate values representing the performance of the fluid system;

using the system performance values to produce one or more command signals, including the steps of selecting a fluid system performance parameter to control, determining a setpoint for the selected fluid system performance parameter, calculating a control signal using the setpoint value of the selected fluid system performance parameter, and calculating the one or more command signals from the control signal; and using the one or more command signals to control the speed of the centrifugal pump, wherein the selected fluid system performance parameter to control is the pump suction pressure, and further comprising the step of deriving the setpoint value for pump suction pressure from a fluid level command.

44. The method of claim 43, further comprising the step of determining the fluid level command, said step of determining the fluid level command comprising the steps of:

defining a fluid system performance characteristic to optimize;

varying the fluid level incrementally through a range of values;

determining a value representing the fluid system performance characteristic for each value of fluid level;

determining for which value of fluid level the value representing the fluid system performance characteristic is optimized; and setting the fluid level command at the level which produces the optimized value.

45. The method of claim 44, wherein the step of determining the fluid level command is automatically repeated at predetermined times.

46. The method of claim 44, further comprising the step of periodically determining the pump efficiency and repeating the step of determining the fluid level command when a decrease in pump efficiency relative to prior determinations of pump efficiency is detected.

47. The method of claim 44, wherein the fluid system is a gas well, further comprising the step of periodically determining the gas production and repeating the step of determining the fluid level command when a decrease in gas production relative to prior determinations of gas production is detected.

48. A method of controlling the performance of a fluid system, wherein a centrifugal pump is used for transferring fluid within said fluid system, the method comprising the steps of:

determining a value of speed input to the centrifugal pump;

determining a value of pump flow rate;

using the value of speed input and the value of pump flow rate to calculate one or more values representing the performance of the centrifugal pump;

using the values representing the performance of the centrifugal pump to calculate values representing the performance of the fluid system;

using the system performance values to produce one or more command signals, including the steps of selecting a fluid system performance parameter to control, determining a setpoint for the selected fluid system performance parameter, calculating a control signal using the setpoint value of the selected fluid system performance parameter, and calculating the one or more command signals from the control signal; and using the command signals to control the speed of the centrifugal pump, wherein the selected fluid system performance parameter to control is the pump suction pressure; and wherein the step of using the command signals to control the speed of the centrifugal pump includes repetitively performing the steps of:

operating the centrifugal pump at a set speed until the pump suction pressure decreases to a value less than or equal to a pump suction pressure lower limit, said pump suction pressure lower limit calculated as the pump suction pressure setpoint minus a tolerance; and operating the centrifugal pump at zero speed until the pump suction pressure increases to a value greater than or equal to a pump suction pressure upper limit, said pump suction pressure upper limit calculated as the pump suction pressure setpoint plus a tolerance.

49. A method of controlling the performance of a fluid system wherein a centrifugal pump is used for transferring fluid within said fluid system, and wherein the centrifugal pump is coupled to an electric motor, the method comprising the steps of:

determining a value of speed input to the centrifugal pump, including the steps of measuring values of electrical voltages applied to the motor and currents drawn by the motor, and using the measured values of electrical voltages applied to the motor and currents drawn by the motor to calculate a value for motor speed determining a value of pump flow rate;

using the value of speed input and the value of pump flow rate to calculate one or more values representing the performance of the centrifugal pump;

using the values representing the performance of the centrifugal pump to calculate values representing the performance of the fluid system, including the steps of selecting a fluid system performance parameter to control, determining a setpoint for the selected fluid system performance parameter, calculating a control signal using the selected fluid system performance parameter, and calculating one or more command signals from the control signal;

using the system performance values to produce the one or more command signals; and using the command signals to control the speed of the centrifugal pump, wherein the selected fluid system performance parameter to control is the pump suction pressure, and further comprising the step of deriving the setpoint value for pump suction pressure from a fluid level command.

50. The method of claim 49, further comprising the step of determining the fluid level command, said step of determining the fluid level command comprising the steps of:

defining a fluid system performance characteristic to optimize;

varying the fluid level incrementally through a range of values;

determining a value representing the fluid system performance characteristic for each value of fluid level;

determining for which value of fluid level the value representing the fluid system performance characteristic is optimized; and setting the fluid level command at the level which produces the optimized value.

51. The method of claim 50, wherein the step of determining the fluid level command is automatically repeated at predetermined times.

52. The method of claim 50, further comprising the step of periodically determining the pump efficiency and repeating the step of determining the fluid level command when a decrease in pump efficiency relative to prior determinations of pump efficiency is detected.

53. The method of claim 50, wherein the system is a gas well, further comprising the step of periodically determining the gas production and repeating the step of determining the fluid level command when a decrease in gas production is detected.

54. A method of controlling the performance of a fluid system wherein a centrifugal pump is used for transferring fluid within said fluid system, and wherein the centrifugal pump is coupled to an electric motor, the method comprising the steps of:

determining a value of speed input to the centrifugal pump, including the steps of measuring values of electrical voltages applied to the motor and currents drawn by the motor, and using the measured values of electrical voltages applied to the motor and currents drawn by the motor to calculate a value for motor speed;

determining a value of pump flow rate;

using the value of speed input and the value of pump flow rate to calculate one or more values representing the performance of the centrifugal pump;

using the values representing the performance of the centrifugal pump to calculate values representing the performance of the fluid system, including the steps of using the system performance values to produce one or more command signals: selecting a fluid system performance parameter to control, determining a setpoint for the selected fluid system performance parameter; calculating a control signal using the selected fluid system performance parameter; and calculating the one or more command signals from the control signal; and using the one or more command signals to control the speed of the centrifugal pump, wherein the selected fluid system performance parameter to control is the pump suction pressure, and wherein the step of using the one or more command signals to control the speed of the centrifugal pump includes repetitively performing the method comprising the steps of operating the centrifugal pump at a set speed until the pump suction pressure decreases to a value less than or equal to a pump suction pressure lower limit, said pump suction pressure lower limit calculated as the pump suction pressure setpoint minus a tolerance; and operating the centrifugal pump at zero speed until the pump suction pressure increases to a value greater than or equal to a pump suction pressure upper limit, said pump suction pressure upper limit calculated as the pump suction pressure setpoint plus a tolerance.

55. A method of controlling the performance of a fluid system wherein at least first and second centrifugal pumps are connected in parallel and are used for transferring fluid within said fluid system and the first and second centrifugal pumps are coupled to first and second electric motors, respectively, the method comprising the steps of:

determining values of speed input to each of the centrifugal pumps, including the steps of measuring values of electrical voltages applied to the first and second motors and currents drawn by the first and second motors and using the measured values of electrical voltages applied to the first and second motors and currents drawn by the first and second motors to calculate for the first and second centrifugal pumps values for at least one of the parameters selected from the group consisting of motor torque and motor speed;

determining values of pump flow rate of each of the centrifugal pumps;

using the values of speed input and pump flow rate to calculate the efficiency of each centrifugal pump;

using efficiency and flow of each centrifugal pump to calculate the speed for each centrifugal pump which would result in the most efficient operation of the fluid system;

using the calculated speed for each centrifugal pump to produce command signals; and using the command signals to control the speed of each centrifugal pump.

56. The method of claim 55, wherein the step of determining the pump flow rate of each of the centrifugal pumps comprises the steps of:

determining values of torque input to each of the centrifugal pumps; and using the values of torque inputs and speed inputs to the first and second motors and currents drawn by the first and second motors to calculate for the first and second centrifugal pumps values for pump flow rate.

57. A method of controlling the performance of a fluid system wherein a centrifugal pump is used for transferring fluid within said fluid system, the method comprising the steps of:

selecting a fluid system performance parameter to control;

determining a setpoint for the selected fluid system performance parameter;

determining values representing the performance of the centrifugal pump;

determining values representing the performance of the fluid system;

using the pump performance values and fluid system performance values to calculate a feedforward signal by predicting a value of mechanical input to the centrifugal pump when operating with the selected centrifugal pump performance value at the setpoint value;

using the feedforward signal to generate command signals; and using the command signals to control the speed of the centrifugal pump.

58. The method of claim 57, wherein the selected fluid system performance parameter to control is the pump suction pressure.

59. The method of claim 58, further comprising the step of deriving the setpoint value for pump suction pressure from a fluid level command.

60. The method of claim 59, further comprising the step of determining the fluid level command, said step of determining the fluid level command comprising the steps of:

defining a fluid system performance characteristic to optimize;

varying the fluid level incrementally through a range of values;

determining a value representing the fluid system performance characteristic for each value of fluid level;

determining for which value of fluid level the value representing the fluid system performance characteristic is optimized; and setting the fluid level command at the level which produces the optimized value.

61. The method of claim 60, wherein the step of determining the fluid level command is automatically repeated at predetermined times.

62. The method of claim 60, further comprising the step of periodically determining the pump efficiency and repeating the step of determining the fluid level command when a decrease in pump efficiency relative to prior determinations of pump efficiency is detected.

63. The method of claim 60, wherein the system is a gas well, further comprising the step of periodically determining the gas production and repeating the step of determining the fluid level command when a decrease in gas production is detected.

64. The method of claim 58, wherein the step of using the command signals to control the speed of the centrifugal pump includes repetitively performing the method comprising the steps of:

operating the centrifugal pump at a set speed until the pump suction pressure decreases to a value less than or equal to a pump suction pressure lower limit, said pump suction pressure lower limit calculated as the pump suction pressure setpoint minus a tolerance; and operating the centrifugal pump at zero speed until the pump suction pressure increases to a value greater than or equal to a pump suction pressure upper limit, said pump suction pressure upper limit calculated as the pump suction pressure setpoint plus a tolerance.

65. A pump control system for controlling a centrifugal pump for transferring fluid within a wellbore, the pump control system comprising:

a plurality of sensors;

means responsive to the sensors for determining values of torque and speed input to the centrifugal pump;

means for using the values of torque and speed input to calculate one or more values representing the performance of the centrifugal pump; and means for using the centrifugal pump performance values to produce one or more command signals for controlling the speed of the centrifugal pump, wherein none of the sensors are located within the wellbore, whereby the values of torque and speed input are derived using sensed values without requiring down hole sensors, wherein said means using the centrifugal pump performance values to produce command signals includes means for calculating a feedback signal indicative of the difference between a current value of a selected centrifugal pump performance parameter and a setpoint value of the selected centrifugal pump performance parameters; and means for calculating the command signals from the feedback signal.

66. The pump control system of claim 65, wherein the selected centrifugal pump performance parameter is the pump flow rate.

67. The pump control system of claim 66, including means for repetitively switching the speed of the centrifugal pump between a set pump speed for a portion of a cycle period and zero speed for the remainder of the cycle period to achieve an average pump flow rate equal to the setpoint value of the pump flow rate.

68. The pump control system of claim 65, wherein the selected centrifugal pump performance parameter is the pump head pressure.

69. A pump control system for controlling a centrifugal pump for transferring fluid within a wellbore, the pump control system comprising:

a plurality of sensors;

means responsive to the sensors for determining values of torque and speed input to the centrifugal pump;

means for using the values of torque and speed input to calculate one or more values representing the performance of the centrifugal pump; and means for using the centrifugal pump performance values to produce one or more command signals for controlling the speed of the centrifugal pump, wherein none of the sensors are located within the wellbore, whereby the values of torque and speed input are derived using sensed values without requiring down hole sensors, wherein said means using the centrifugal pump performance values to produce command signals includes means for calculating a feedforward signal by predicting a value of mechanical input to the centrifugal pump when operating with the selected centrifugal pump performance value at the setpoint value, and means for calculating the command signals from the feedforward signal.

70. A pump control system for controlling a centrifugal pump for transferring fluid within a fluid system, the pump control system comprising:

means for determining a value of speed input to the centrifugal pump;

means for determining a value of pump flow rate of the centrifugal pump;

means for using the values of pump flow rate and speed input to calculate one or more values representing the performance of the centrifugal pump; and means for using the centrifugal pump performance values to produce one or more command signals for controlling the speed of the centrifugal pump;

means for calculating a feedforward signal by predicting a value of mechanical input to the centrifugal pump when operating with the selected centrifugal pump performance value at the setpoint value, and means for calculating the command signals from the feedforward signal.

71. The pump control system of claim 70, wherein said means for using the centrifugal pump performance values to produce command signals includes means for calculating a feedback signal indicative of the difference between a current value of a selected centrifugal pump performance parameter and a setpoint value of the selected centrifugal pump performance parameter, and means for calculating the command signals from the feedback signal.

72. The pump control system of claim 71, wherein the selected centrifugal pump performance parameter is the pump head pressure.

73. The pump control system of claim 71, wherein the selected centrifugal pump performance parameter is the pump flow rate, including means for repetitively switching the speed of the centrifugal pump between a set pump speed for a portion of a cycle period and zero speed for the remainder of the cycle period to achieve an average pump flow rate equal to the setpoint value of the pump flow rate.

74. The pump control system of claim 70, wherein said means for using the centrifugal pump performance values to produce command signals includes means for calculating a feedforward signal by predicting a value of mechanical input to the centrifugal pump when operating with the selected centrifugal pump performance value at the setpoint value, and means for calculating the command signals from the feedforward signal.

75. A pump control system for controlling a centrifugal pump for transferring fluid within a gas or oil well, the pump control system comprising:

means to calculate one or more values representing the performance of the centrifugal pump;

means for using the values representing the performance of the centrifugal pump to calculate values representing the performance of the well;

means for using at least one of the well performance values to calculate a feedforward signal; and means responsive to at least one of the well performance values and to the feedforward signal to produce one or more command signals for controlling the speed of the centrifugal pump.

76. The pump control system of claim 75, wherein said means for using the performance values to produce command signals includes means for calculating a feedback signal indicative of the difference between a current value of the selected performance parameter and a setpoint value of the selected performance parameter; and means for using the feedback signal to calculate the command signals.

77. The pump control system of claim 76, wherein the selected performance parameter is the pump suction pressure.

78. The pump control system of claim 77, wherein said means for using the performance values to produce command signals includes means for calculating the setpoint for pump suction pressure from a fluid level command.

79. The pump control system of claim 78, wherein said means for using the well performance values to produce command signals includes means for periodically determining gas or oil production and adjusting fluid level command in response to detection of a decrease in gas or oil production.

80. The pump control system of claim 77, wherein said means for using the command signals to control the speed of the centrifugal pump includes means for operating the centrifugal pump at a set speed until the pump suction pressure decreases to a value less than or equal to a pump suction pressure lower limit that is equal to the pump suction pressure setpoint minus a tolerance; and means for operating the centrifugal pump at zero speed until the pump suction pressure increases to a value greater than or equal to a pump suction pressure upper limit that is equal to the pump suction pressure setpoint plus a tolerance.

81. The pump control system of claim 75, wherein said means for calculating the feedforward signal includes means for predicting a value of mechanical input to the centrifugal pump when operating with the selected pump performance value at the setpoint value.

82. A pump control system for controlling at least first and second centrifugal pumps connected in parallel for transferring fluid within a fluid system, the pump control system comprising:

means to determine values for the efficiency and flow of each centrifugal pump;

means for using the values of efficiency and flow of each centrifugal pump to calculate a speed for each centrifugal pump which would result in the most efficient operation of the fluid system;

means for using the calculated speed for each centrifugal pump to produce command signals; and means for using the command signals to control the speed of each centrifugal pump, wherein at least one centrifugal pump is coupled to an electric motor and the means for determining the efficiency and flow rate of at least one centrifugal pump coupled to an electric motor includes means for measuring the electrical voltages applied to the motor and currents drawn by the motor; and means for using the measured values of electrical voltages applied to the motor and currents drawn by the motor to calculate at least one of the values selected from the group consisting of motor torque and motor speed.

83. A pump control system for controlling a centrifugal pump for transferring fluid within a fluid system, the pump control system comprising:

means for determining values representing the performance of the centrifugal pump;

means for using the values representing the performance of the centrifugal pump for determining values representing the performance of the fluid system;

means for using at least one of the fluid system performance values for calculating a feedforward signal by predicting a value of mechanical input to the centrifugal pump when operating with a selected centrifugal pump performance value at a setpoint value; and means for calculating from the feedforward signal one or more command signals for controlling the speed of the centrifugal pump.

84. The pump control system of claim 83, wherein the selected performance parameter is the pump suction pressure.

85. The pump control system of claim 84, wherein said means for calculating a feedforward signal includes means for calculating the setpoint for pump suction pressure from a fluid level command.

86. The pump control system of claim 85, wherein said means for calculating a feedforward signal includes means for periodically determining gas or oil production and adjusting fluid level command in response to detection of a decrease in gas or oil production.

87. The pump control system of claim 84, wherein said means for using the command signals to control the speed of the centrifugal pump includes means for operating the centrifugal pump at a set speed until the pump suction pressure decreases to a value less than or equal to a pump suction pressure lower limit that is equal to the pump suction pressure setpoint minus a tolerance; and means for operating the centrifugal pump at zero speed until the pump suction pressure increases to a value greater than or equal to a pump suction pressure upper limit that is equal to the pump suction pressure setpoint plus a tolerance.

88. A pump control system for controlling a centrifugal pump for transferring fluid within a gas or oil well, the pump control system comprising:

means for determining values representing the performance of the centrifugal pump;

means for using the values representing the performance of the centrifugal pump for determining values representing the performance of the well;

means for using at least one of the well performance values for calculating a feedforward signal by predicting a value of mechanical input to the centrifugal pump when operating with a selected centrifugal pump performance value at a setpoint value; and means for calculating from the feedforward signal one or more command signals for controlling the speed of the centrifugal pump.

89. The pump control system of claim 88, wherein the selected performance parameter is the pump suction pressure.

90. The pump control system of claim 89, wherein said means for calculating a feedforward signal includes means for calculating the setpoint for pump suction pressure from a fluid level command.

91. The pump control system of claim 90, wherein said means for calculating a feedforward signal includes means for periodically determining gas or oil production and adjusting fluid level command in response to detection of a decrease in gas or oil production.

92. The pump control system of claim 89, wherein said means for using the command signals to control the speed of the centrifugal pump includes means for operating the centrifugal pump at a set speed until the pump suction pressure decreases to a value less than or equal to a pump suction pressure lower limit that is equal to the pump suction pressure setpoint minus a tolerance; and means for operating the centrifugal pump at zero speed until the pump suction pressure increases to a value greater than or equal to a pump suction pressure upper limit that is equal to the pump suction pressure setpoint plus a tolerance.

* * * * *

UNITED STATES PATENT AND TRADEMARK OFFICE

CERTIFICATE OF CORRECTION

PATENT NO. : 7,117,120 B2
APPLICATION NO. : 10/656091
DATED : October 3, 2006
INVENTOR(S) : Thomas L. Beck et al.

It is certified that error appears in the above-identified patent and that said Letters Patent is hereby corrected as shown below:

Col. 16, Line 57: "(Vds-Is.Rs)/s" should be --(Vds-Ids.Rs) /s--

Signed and Sealed this

Twenty-eighth Day of August, 2007

JON W. DUDAS
*Director of the United States Patent and Trademark Office*